US008023867B2

(12) United States Patent
Takano et al.

(10) Patent No.: US 8,023,867 B2
(45) Date of Patent: Sep. 20, 2011

(54) MAGNET ROLLER AND METHOD FOR THE SAME, MAGNETIC PARTICLE-SUPPORT MEMBER, DEVELOPMENT DEVICE, PROCESS CARTRIDGE, AND IMAGE FORMING APPARATUS

(75) Inventors: Yoshiyuki Takano, Hachioji (JP); Tsuyoshi Imamura, Sagamihara (JP); Kyohta Koetsuka, Fujisawa (JP); Noriyuki Kamiya, Yamato (JP); Masayuki Ohsawa, Atsugi (JP); Hiroya Abe, Yokohama (JP); Takashi Innami, Atsugi (JP); Tadaaki Hattori, Hadano (JP); Mieko Terashima, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 627 days.

(21) Appl. No.: 12/040,450

(22) Filed: Feb. 29, 2008

(65) Prior Publication Data

US 2008/0213007 A1 Sep. 4, 2008

(30) Foreign Application Priority Data

Mar. 1, 2007 (JP) ..... 2007-051363

(51) Int. Cl.
*G03G 15/09* (2006.01)

(52) U.S. Cl. ..... 399/267; 399/277

(58) Field of Classification Search ..... 399/267, 399/277; 492/8, 18, 47
See application file for complete search history.

(56) References Cited

U.S. PATENT DOCUMENTS

| | | | | |
|---|---|---|---|---|
| 6,061,541 | A * | 5/2000 | Bessette | 399/277 |
| 6,850,140 | B1 * | 2/2005 | Gleckner | 335/306 |
| 7,503,367 | B2 * | 3/2009 | Uyttenboogaart | 156/414 |
| 2008/0298849 | A1 | 12/2008 | Imamura et al. | |

FOREIGN PATENT DOCUMENTS

| | | |
|---|---|---|
| JP | 5-33802 | 5/1993 |
| JP | 5-142947 | 6/1993 |
| JP | 8-334983 | 12/1996 |
| JP | 2000-68120 | 3/2000 |
| JP | 2000-243620 | 9/2000 |
| JP | 2000-269024 | 9/2000 |
| JP | 2004-78040 | 3/2004 |
| JP | 2004-311771 | 11/2004 |
| JP | 2005-70297 | 3/2005 |
| JP | 3989158 | 7/2007 |

* cited by examiner

*Primary Examiner* — David Gray
*Assistant Examiner* — Barnabas Fekete
(74) *Attorney, Agent, or Firm* — Oblon, Spivak, McClelland, Maier & Neustadt, L.L.P.

(57) ABSTRACT

A magnet roller includes a cylindrical roller body including a side surface in which a groove is formed, a magnet body which is disposed in the groove, and a magnetic metal member which is attached to a surface of the magnet body, which is remote from an opening of the groove.

17 Claims, 11 Drawing Sheets

MAGNET ROLLER AND METHOD FOR THE SAME, MAGNETIC PARTICLE-SUPPORT MEMBER, DEVELOPMENT DEVICE, PROCESS CARTRIDGE, AND IMAGE FORMING APPARATUS

CROSS REFERENCE TO RELATED APPLICATIONS

The present application is based on and claims priority from Japanese Application Number 2007-051363, fled on Mar. 1, 2007, the disclosure of which is hereby incorporated by reference herein in its entirety.

BACKGROUND OF THE INVENTION

1. Field of the Invention

The present invention relates to a magnet roller, a magnetic particle-support member, a development device, a process cartridge, and an image forming apparatus used for copying machines, facsimiles, printers or the like. More specifically, the present invention relates to a magnetic particle-support member, by which an electrostatic latent image on an image carrier is developed with a developer including toner and carrier having magnetic particles to form a toner image, a magnet roller using such a magnetic particle-support member, and a development device having such a magnetic particle-support member. In addition, the present invention relates to a process cartridge and an image forming apparatus having such a development device.

2. Description of Related Art

In general, a development device has a developer-support member as a magnet particle-support member, which is configured to convey developer to a development area facing an image-support member and develop an electrostatic latent image formed on the image-support member to form a toner image. The developer-support member includes, for example, a cylindrical non-magnetic sleeve, that is, a development sleeve as well as a magnetic field-generation device, for example, a magnet roller, which generates a magnetic field to form raised portions or ears of the developer on a surface of the development sleeve.

The developer has toner and carrier including magnetic particles. When forming the raised portion of the developer, the carrier of the developer is raised on the development sleeve along magnetic field lines generated by the magnet roller and the charged toner is attached to the raised carrier.

The magnet roller has a side surface in which at least one magnet is disposed or buried and the magnet forms a plurality of magnetic poles. The magnet forming each of the magnetic poles is formed in a rod-like shape and, in particular, forms a development pole to form the raised portion of the developer on a part corresponding to a development area of the development sleeve. By rotating at least one of the development sleeve and the magnet roller, the developer raised by the pole is moved in a circumferential direction of the development sleeve or the magnet roller. In general, the development sleeve has a surface which is processed by a roughening process such as a groove processing, a sandblast processing or the like so that the developer is easily conveyed. Such a groove processing and a sandblast processing are performed in order to prevent reduction of image density occurring when the developer slips and is interrupted on the surface of the development sleeve which rotates at high speed.

FIG. 19 shows a conventional development device. Reference number 200 denotes a development device. The development device 200 has a developer-support member 204 configured to convey the developer to the development area facing an image-support member 211 and develop an electrostatic latent image formed on a surface of the image-support member 211 to form the toner image. In addition, the developer-support member 204 includes a cylindrical development sleeve 202 and a magnet roller 201 which is contained in the development sleeve 202 and generates a magnetic field so as to form raised portions of a developer 208 on a surface of the development sleeve 202. On the developer-support member 204, when the developer 208 is raised, magnetic carrier of the developer 208 is raised on the development sleeve 202 along magnetic field lines generated by the magnet roller 201 and toner of the developer 208 is attached to the raised magnetic carrier.

Such a development device 200 includes a developer container 207 to contain the above-mentioned developer, an agitating screw 206 which agitates the developer contained in the developer container 207, and a developer control member 205 which uniformly controls an amount of the developer picked up on the developer-support member 204.

The development device 200 shown in FIG. 19 is provided with the developer container having a pair of developer-containing tanks 207*a*, 207*b* and the agitating screw 206 having a pair of agitating screw members 206*a*, 206*b*. The developer in the development device 200 moves in an axial direction of the agitating screw 206 in the developer container 207. The toner supplied from an end portion of the developer-containing tank 207*b* which is away from the developer-support member 204, is conveyed to another end portion of the developer-containing tank 207*b* along an axial direction of the agitating screw member 206*b* by the agitating screw member 206*b* while being agitated with the developer. The developer is moved from the other end portion of the developer-containing tank 207*b* to the other developer-containing tank 207*a* which is close to the developer-support member 204. The developer moved to the developer-containing tank 207*a* is picked up to the surface of the development sleeve 202 by a magnetic force of the magnet roller 201. That is to say, the developer is attached to the surface of the development sleeve 202. After that, an amount of the developer is uniformly controlled by the developer control member 205, and then the developer is conveyed to a development area where the image-support member 211 and the developer-support member 204 are disposed to face each other with an interval. An electrostatic latent image formed on the image-support member 211 is developed with the developer 208 to form a toner image.

In recent years, colorization of electronic copying machines and printers has been advanced. Since a color copying machine requires four development devices, a reduced size of the development devices is desired to reduce the size of machines. In order to reduce the size of the development devices, the size of developer-support members contained each development device is also required to be reduced. The size reduction of the development device, however, causes problems as follows.

(1) In the development device, in order to prevent the developer from attaching to the image-support member as an electrostatic latent image-support member, it is necessary for a development main pole and adjacent poles to have high magnetic forces (generally, 100 mT or more on the developer-support member). However, because a volume of each magnet of the small size developer-support member is reduced, it is difficult for the small size developer-support member to generate a high magnetic force.

(2) In the case of the small size developer-support member, the developer-support member has low work-stiffness so that the developer-support member is easily deformed when being processed by a sandblast processing, or the like which is used as a conventional surface processing. Accordingly, it is difficult to achieve high accuracy of the developer-support member.

(3) In a case of the developer-support member having a small diameter, the magnetic force greatly changes due to a distance from the support member so that it is difficult to suck and stably maintain the developer onto the developer-support member.

To solve the above problems, for example, Japanese Patent Application Publication No. H05-033802 discloses a method in which a magnetic field is virtually oriented in a multi-pole state so that multi poles are disposed to form magnetic poles in spite of an integral construction. However, there are problems in that the main pole may achieve only a magnetic force of about 90 mT on the developer support member, in that complex structures are required in a die because of the multi-pole configuration, and the like.

Japanese Patent Application Publication No. 2000-068120 proposes configurations where a magnet block which is made of a plastic resin and metal powder having high magnetism such as metal powder made of rare earth alloys is attached to a part of a roll made of a plastic magnet.

However, a large quantity of magnetic materials are blended in order to obtain high magnetism, so that such a magnet block has low mechanical strength. Therefore, even after the magnet roll which is formed by the magnet block together with a roll made of a plastic magnet is obtained, the magnet roll is easily affected by, for example, damage or cracks which occur when being treated. In addition, after the magnet roll is attached to the image forming apparatus, the magnet block is possibly affected by shocks causing damage or cracks so that image failure or lack of durability occurs. Furthermore, these problems specifically affect application to long roll requirements, for example, in A3 paper-enabled machines.

SUMMARY OF THE INVENTION

An object of the present invention is to provide a magnet roller which generates high magnetic force density and by which damage to the magnet block, failure of image forming, and the like can be prevented so that the magnet roller has excellent durability.

To achieve the above object, a magnet roller according to an embodiment of the present invention includes a cylindrical roller body including a side surface in which a groove is formed, a magnet body which is disposed in the groove, and a magnetic metal member which is attached to a surface of the magnet body, which is remote from an opening of the groove.

DETAILED DESCRIPTION OF THE PREFERRED EMBODIMENTS

Preferred embodiments of the present invention will be explained in detail with reference to the accompanying drawings below. A magnet roller according to the present invention is used, for example, in an image forming apparatus. An image forming apparatus 101 having a magnet roller 133 according to an embodiment of the present invention will be described with reference to FIGS. 1 to 18.

Figure 1:
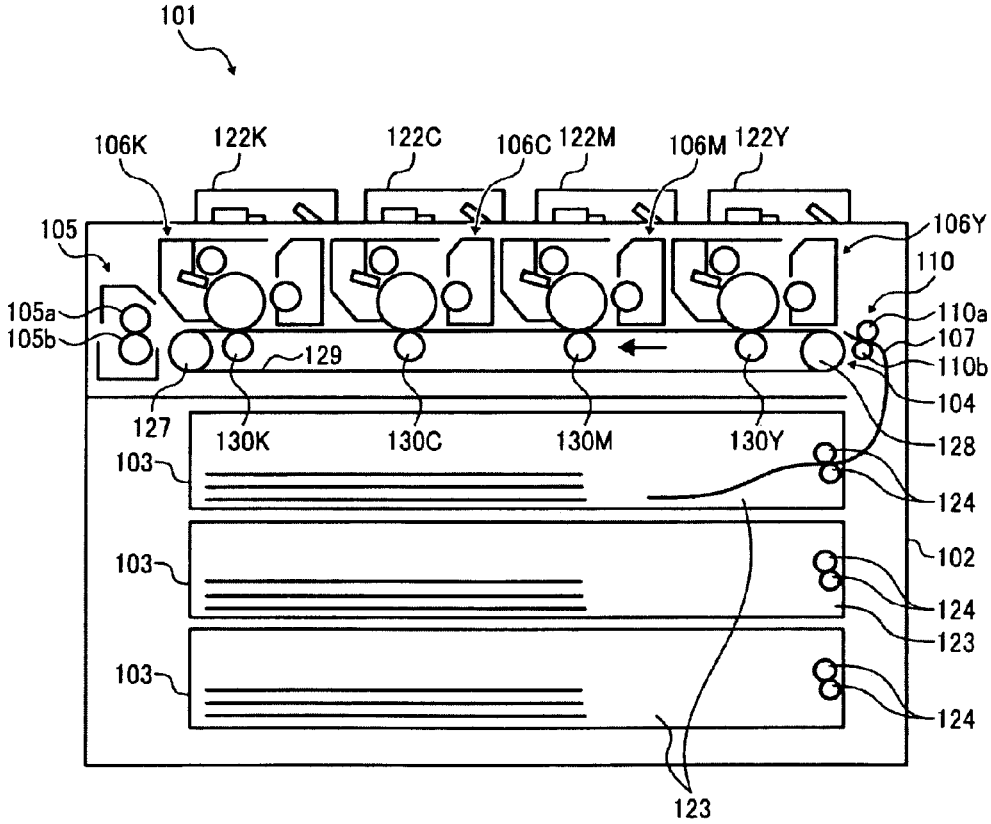
FIG. 1 is a schematic view showing an image forming apparatus having a magnet roller according to an embodiment of the present invention, which is used in a development device of a process cartridge.
Figure 2:
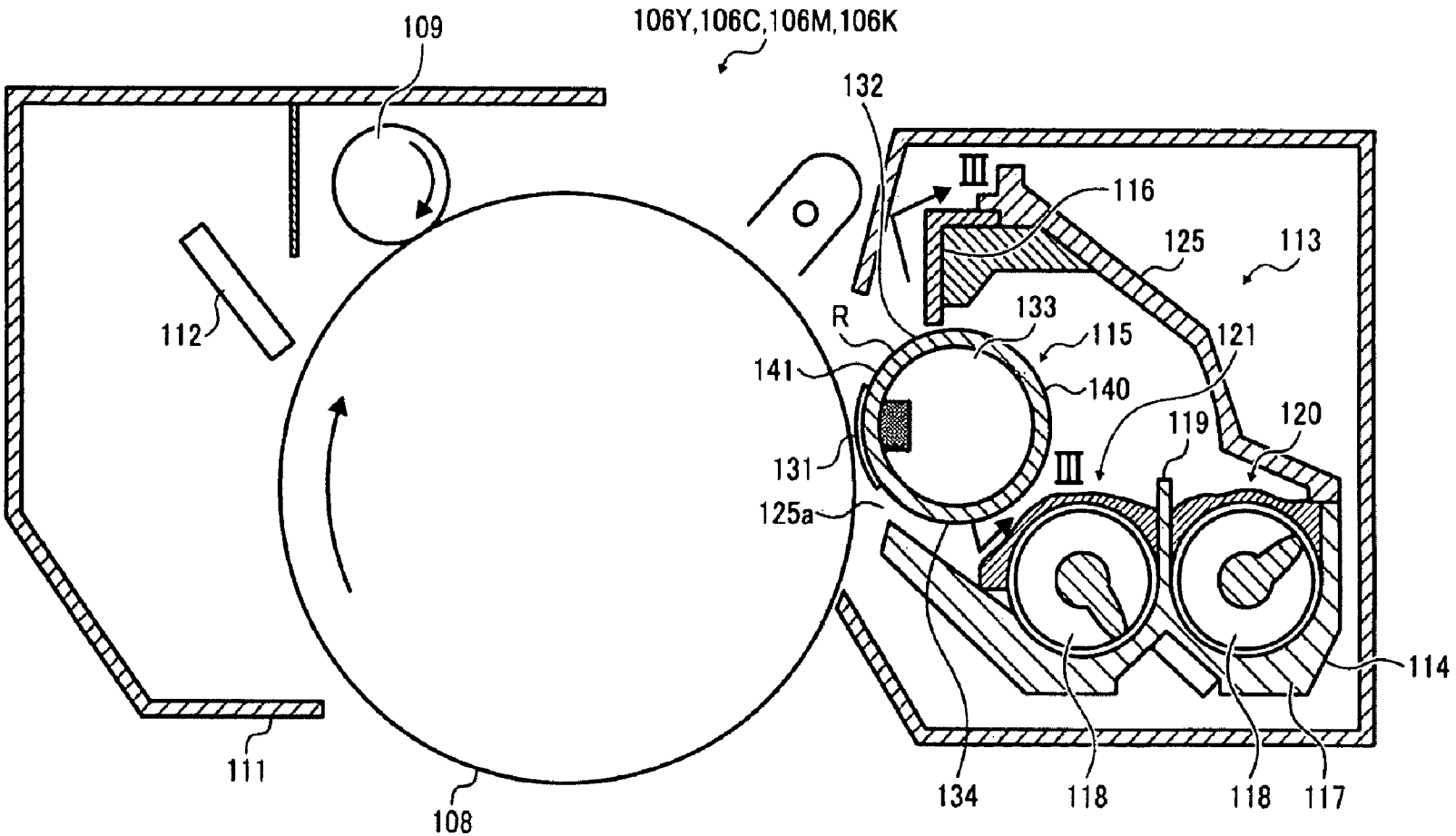
FIG. 2 is a schematic view showing a process cartridge having a development device using a magnet roller according to an embodiment of the present invention.
Figure 3:
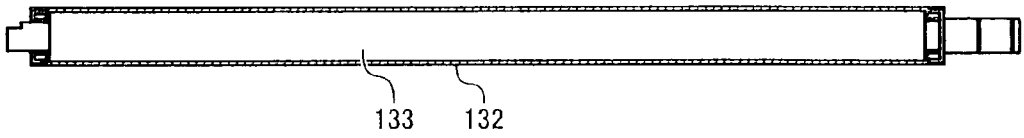
FIG. 3 is a sectional view showing a development roller taken along line III-III shown in FIG. 2.
Figure 4:
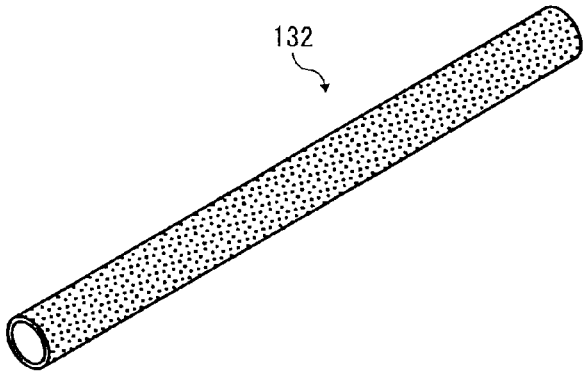
FIG. 4 is a schematic perspective view showing a development sleeve of the process cartridge shown in FIG. 2.

FIG. 1 is an explanatory view showing configurations of the image forming apparatus 101 including a development device 113 using the magnet roller 133 according to an embodiment of the present invention, viewed from a front side. FIG. 2 is a sectional view of the development device 113 of the image forming apparatus 101 shown in FIG. 1. FIG. 3 is a sectional view of the magnet roller in section along a line III-III of FIG. 2. FIG. 4 is a perspective view showing a development sleeve 132 of the development device 113 shown in FIG. 3.

The image forming apparatus 101 is configured to form a color image from images of each color of yellow (Y), magenta (M), cyan (C), black (K) on a recording paper 107

(see FIG. 1) as a transfer material. Here, each unit corresponding to each color of yellow, magenta, cyan, and black is shown by adding Y, N, C, and K after each reference number.

The image forming apparatus 101 includes at least a main body 102, a paper supplying unit 103, a resist roller pair 110, a transfer unit 104, a fixing unit 105, a plurality of laser writing units 122Y, 122M, 122C, and 122K, and a plurality of process cartridges 106Y, 106N, 106C, and 106K as shown in FIG. 1.

The main body 102 is, for example, formed in a box shape and mounted on a floor. The main body 102 contains the paper supplying unit 103, the resist roller pair 110, the transfer unit 104, the fixing unit 105, the plurality of laser writing units 122Y, 122M, 122C, and 122K, and the plurality of process cartridges 106Y, 106M, 106C, and 106K.

A plurality of paper supplying units 103 are provided on a lower portion of the main body 102. The paper supplying unit 103 houses the above-mentioned recording papers in a stacked state, and includes a paper supplying cassette 123 which is capable of moving in and from the main body 102 and a paper supplying roller 124. The paper supplying roller 124 is compressed on the recording paper 107 which is positioned on a top in the paper supplying cassette 123. The paper supplying roller 124 sends the above-mentioned top recording paper 107 to an area between a below-mentioned conveying belt 129 of the transfer unit 104 and a photoconductive drum 108 of the development device 113 of each of the process cartridges 106Y, 106M, 106C, and 106K.

The resist roller pair 110 is provided on a conveying line of the recording paper 107 from the paper supplying unit 103 to the transfer unit 104, and includes a pair of rollers 110*a*, 110*b*. The resist roller pair 110 pinches the recording paper 107 between the pair of rollers 110*a*, 110*b* and sends the pinched recording paper 107 between the transfer unit 104 and each of the process cartridges 106Y, 106M, 106C, and 106K at a time when the pinched recording paper can be overlapped on a toner image.

The transfer unit 104 is provided upward of the paper supplying unit 103. The transfer unit 104 includes a driving roller 127, a driven roller 128, the conveying belt 129 and the plurality of transfer rollers 130Y, 130M, 130C, 130K. The driving roller 127 is disposed downstream of a conveying direction of the recording paper 107 and is rotated to be driven by a motor as a driving source, and so on. The driven roller 128 is rotatably supported on the main body 102 and is disposed upstream of the conveying direction of the recording paper 107. The conveying belt 129 is formed in an endless annular shape and is tacked across both of the driving roller 127 and the driven roller 128 mentioned above. The conveying belt 129 rotates clockwise around the driving roller 127 and the driven roller 128 mentioned above due to a rotational drive of the driving roller 127.

The conveying belt and the recording paper 107 on the conveying belt 129 are pinched between each of the transfer rollers 130Y, 130M, 130C, 130K and each of the corresponding photoconductive drums 108 of the process cartridges 106Y, 106M, 106C, and 106K. The transfer unit 104 allows the recording paper 107 sent from the paper supplying unit 103 to be compressed on each of the outer surfaces of the photoconductive drums 108 of the process cartridges 106Y, 106M, 106C, and 106K so that the toner image is transferred on the recording paper 107. The transfer unit 104 sends the recording paper 107 on which the toner image is transferred to the fixing unit 105.

The fixing unit 105 is provided downstream of the conveying direction of the recording paper 107 of the transfer unit 104 and includes a pair of rollers 105*a*, 105*b* which are configured to pinch the recording paper 107 therebetween. The fixing unit 105 compresses and heats the recording paper 107, which is sent from the transfer unit 104 and passed between the pair of rollers 105*a*, 105*b*, so that the toner image transferred from the photoconductive drum 108 to the recording paper 107 is fixed thereon.

The laser writing units 122Y, 122M, 122C, and 122K are mounted on upper portions of the main body 102, respectively. The laser writing units 122Y, 122M, 122C, and 122K correspond to the process cartridges 106Y, 106M, 106C, and 106K. Each of the laser writing units 122Y, 122M, 122C, and 122K irradiates the outer surfaces of each photoconductive drum 108 which is charged uniformly by a charged roller 109 (mentioned below) of each of the process cartridges 106Y, 106M, 106C, and 106K with laser light to form the electrostatic latent image.

The plurality of process cartridges 106Y, 106M, 106C, and 106K are provided between the transfer unit 104 and the laser writing unit 122Y, 122M, 122C, and 122K, respectively. The process cartridges 106Y, 106M, 106C, and 106K are removably provided on the main body 102. The process cartridges 106Y, 106M, 106C, and 106K are provided parallel to each other along the conveying direction of the recording paper 107.

Each of the process cartridges 106Y, 106M, 106C, and 106K includes at least a cartridge case 111, the charged roller 109 as a charging device, the photoconductive drum 108 as a photoconductor, a cleaning blade 112 as a cleaning device, and the development device 113 as shown in FIG. 2. Therefore, the image forming apparatus 101 includes at least the charged roller 109, the photoconductive drum 108, the cleaning blade 112, and the development device 113.

The cartridge case 111 is detachably disposed on the main body 102 and contains the charged roller 109, the photoconductive drum 108, the cleaning blade 112, and the development device 113. The charged roller 109 charges uniformly the outer surface of the photoconductive drum 108. The photoconductive drum 108 is disposed with an interval from a development roller 115 (mentioned below) of the development device 113. The photoconductive drum 108 is formed in a cylindrical or tube-like shape to be capable of rotating about an axis. The photoconductive drum 108 provides the electrostatic latent image thereon by the corresponding laser writing unit 122Y, 122M, 122C, and 122K. Toner is attached to the electrostatic latent image, which is formed and supported on the outer surface of the photoconductive drum 108, so that the toner image is formed on the photoconductive drum 108. The toner image is transferred to the recording paper 107 positioned between the conveying belt 129 and the photoconductive drum 108. The cleaning blade 112 removes toner remaining on the outer surface of the photoconductive drum 108 after transferring the toner image onto the recording paper 107.

The development device 113 includes at least a developer supplying portion 114, a case 125, the development roller 115 as a developer supporting body, and a control blade 116 as a control member as shown in FIG. 2.

The developer supplying portion 114 includes a containing tank 117 and a pair of agitating screws 118 as agitating members. The containing tank 117 is formed in a box shape having almost the same length as that of the photoconductive drum 108. Provided in the containing tank 117 is a partition wall 119 extending in a longitudinal direction of the containing tank 117. The partition wall 119 partitions the containing tank 117 into a first space 120 and a second space 121. Each end of the first space 120 and the second space 121 communicates with each other.

Developer is contained in both the first space 120 and the second space 121 of the containing tank 117. The developer includes the toner and a magnetic carrier 136 (also referred to as magnetic powder, a section thereof being schematically shown in FIG. 9). The toner is accordingly provided to an end of the first space 120 which is away from the development roller 115 of the first and second spaces 120 and 121. The toner includes spherical fine particles which are produced by, for example, an emulsion polymerization method, a suspension polymerization method, or the like. In addition, the toner may be obtained by crushing a mass composed of a synthetic resin in which various dyes or pigments are incorporated or dispersed. A mean diameter of the toner particles is preferably 3 to 7 μm. The toner particles may be formed by a grinding process.

Figure 9:
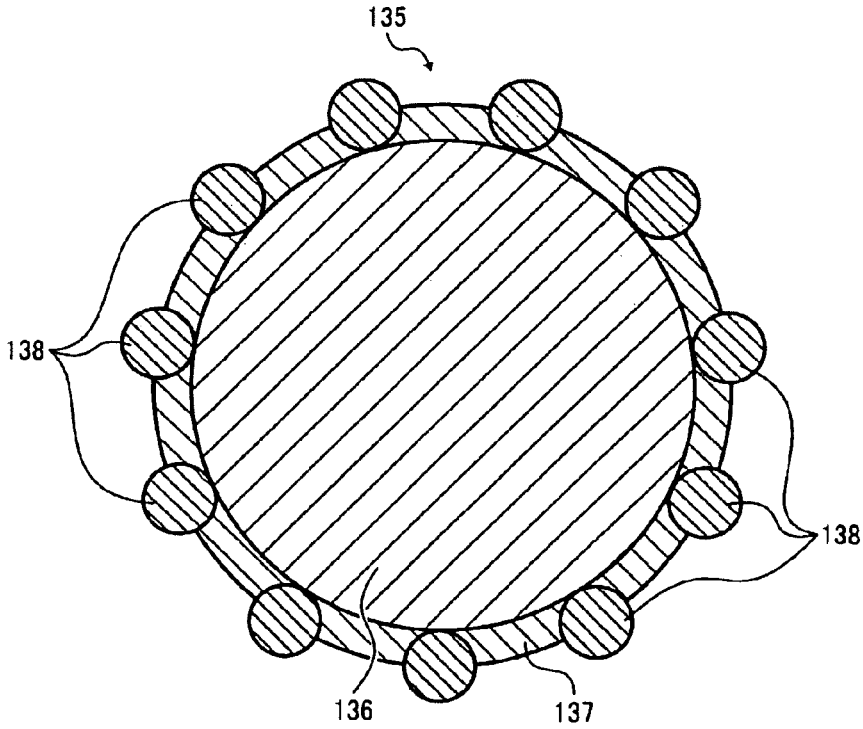
FIG. 9 is a schematic sectional view illustrating a magnetic carrier particle of developer used in the development device shown in FIG. 2.

The magnetic carrier 135 is contained in both the first space 120 and the second space 121. A mean diameter of the magnetic carrier particles 135 is preferably from 20 μm to 50 μm. Each of the magnetic carrier particles 135 includes a core member 136, a plastic coating membrane 137 coating an outer surface of the core member 136, and an aluminum particle 138 dispersed in the plastic coating membrane 137 as schematically shown in FIG. 9.

The core member 136 is formed of a ferrite as a magnetic material and formed in a spherical shape. The plastic coating membrane 137 entirely coats the outer surface of the core member 136. The plastic coating membrane 137 includes a resin composition in which a thermoplastic resin such as an acrylic resin and a melamine resin are cross-linked and a charge adjusting agent. The plastic coating membrane 137 has elasticity and strong adhesive property. The aluminum particle 138 is formed in a larger spherical form than a thickness of the plastic coating membrane 137. The aluminum particle 138 is held by the strong adhesive force of the plastic coating membrane 137. The aluminum particle 138 is projected outwardly on the magnetic carrier 135 from the plastic coating membrane 137.

The agitating screws 118 are contained in the first space 120 and the second space 121. Longitudinal directions of the agitating screws 118 are in a direction parallel to longitudinal directions of the containing tank 117, the development roller 115 and the photoconductive drum 108. Each of the agitating screws 118 is rotatably disposed about the axis and the rotation of the agitating screws causes the toner and the magnetic carrier 135 to be agitated and the developer 126 conveyed along the axis.

In the illustrated embodiment, the agitating screw 118 in the first space 120 conveys the developer 126 from the mentioned end to another end. The agitating screw 118 in the second space 121 conveys the developer 126 from the other end to an end.

According to the above-mentioned structures, the developer supplying portion 114 conveys the toner provided to the end of the first space 120 to the other end while agitating with the carrier 135, and then conveys from the other end to the other end of the second space 121. The developer supplying portion 114 agitates the toner and the magnetic carrier 135 in the second space 121, and then, provides them on an outer surface of the development roller 115 while conveying in a direction of the axis.

The case 125 is formed in a box shape and mounted on the containing tank 117 of the above developer supplying portion 114 to cover the development roller 115 as well as the containing tank 117, and so on. Furthermore, an opening 125*a* is provided on an opposing part from the photoconductive drum 108 of the case 125.

The development roller 115 is formed in a cylindrical shape and provided between the second space 121 and the photoconductive drum 108 and near the above-mentioned opening 125*a*. The development roller 115 is in a direction parallel to both of the photoconductive drum 108 and the containing tank 117. The development roller 115 is disposed with an interval from the photoconductive drum 108.

The development roller 115 is provided with the magnet roller 133 and the above-mentioned development sleeve 132 formed in a cylindrical form. A cored bar conventionally used in the conventional magnet roller is not used in the magnet roller according to an embodiment of the present invention.

Figure 5A:
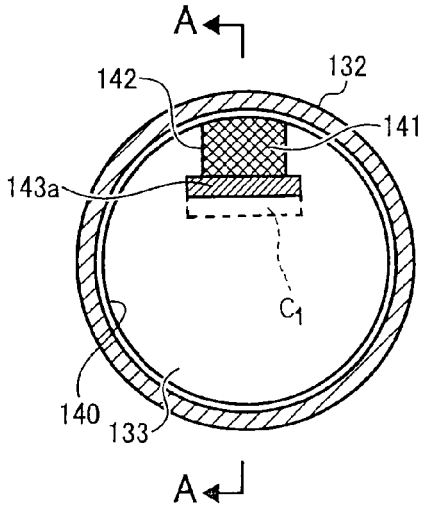
FIG. 5A is a sectional view showing a development roller formed by a magnet roller according to an example of the present invention and a development sleeve.
Figure 5B:
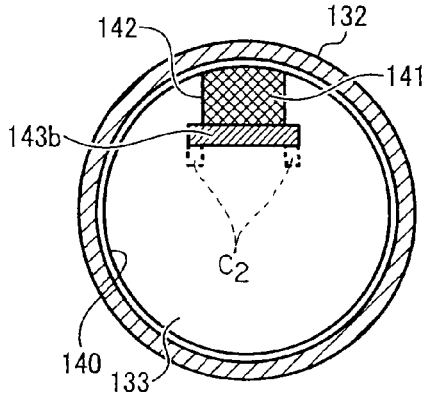
FIG. 5B is a sectional view showing a development roller formed by a magnet roller according to another example of the present invention and a development sleeve.

As shown in FIGS. 5A and 5B, the magnet roller 133 includes a cylindrical roller body 140 having a side surface in which a groove 142 is formed, a magnet block 141 as a magnet body which is disposed in the groove 142, and a magnetic metal member 143*a* (143*b*) which is attached to a surface of the magnet body, which is remote from an opening of the groove 142. The magnetic metal member 143*a* (143*b*) is disposed adjacent to an axis side surface of the magnet body 141, which is close to an axis of the roller body 140. The groove has a rectangular shape in section perpendicular to an axis of the roller body 140 and a flat bottom surface. The magnetic metal member 143*a* (143*b*) is adjacent to the bottom surface of the groove 142.

The groove 142 extends in a longitudinal direction of the roller body 140. The groove 142 has a substantially rectangular section in a direction perpendicular to the axis and the magnet body 141 is buried in the groove of the roller body 140. The long magnetic metal member 143*a* (143*b*) which is formed in a substantially rectangular form in section perpendicular to a longitudinal axis is provided adjacent to an axis side of the magnet body 141, which is disposed near the axis of the magnet roller 133. The above-mentioned magnet roller is contained or housed in the development sleeve 133. The magnetic metal member 143*a* (143*b*) has an axis which is parallel to the axis of the roller body 140.

The roller body 140 of the magnet roller 133 is formed of a magnetic material and formed in a cylindrical form. The roller body 140 is produced by an injection molding in a magnetic field or an extruding molding in a magnetic field. The roller body 140 is normally formed of a plastic magnet or a rubber magnet in which a polymer compound is mixed in magnetic powder such as Sr (strontium) or Ba (barium). The roller body 140 of the magnet roller 133 may be formed by a polymer compound, for example a PA-type material such as 6PA, 12PA, or the like, an ethylene-type compound such as EEA (ethylene ethylacrylate copolymer), EVA (ethylene vinyl acetate copolymer), or the like, a chlorine-type material such as CPE (chlorinated polyethylene), or the like, or a rubber material such as NBR, or the like.

As shown in FIGS. 5A and 5B, the roller body 140 of the magnet roller 133 is provided also with fixed magnetic poles (not shown) as well as the long groove 142 extending in the longitudinal direction of the magnet roller 133 and having the rectangular section in the direction perpendicular to the axis and the flat bottom surface. The groove 142 is formed in a concave shape from the outer surface of the roller body 140 of the magnet roller 133 and in a rectangular shape in section. The groove 142 extends linearly along the longitudinal direction of the roller body 140 of the magnet roller 133 and is provided along the entire length of the roller body 140.

The groove 142 is provided at a position facing the photoconductive drum 108, that is to say, at a portion corresponding to a development area 131 as mentioned later.

The fixed magnetic poles provided on the roller body 140 of the magnet roller 133 is formed by N poles and S poles provided on a part of the roller body 140. Each of the fixed magnetic pole is disposed extending along the longitudinal direction of the roller body 140 of the magnet roller 133 and provided entirely in the length of the roller body 140.

On the axis side of the magnet body 141 in the cylindrical magnet, that is to say, a lower portion of the groove 142 (opposite side from the development area), the long magnetic metal member 143*a* or 143*b* is, for example, integrally molded along the entire length of the roller body 140 of the magnet roller 133. The magnetic metal member 143*a* has a convex portion $C_1$, which is provided on a center thereof in the longitudinal direction and extends in a direction away from the opening of the groove 142, that is to say, extends toward the axis of the magnet roller 133. The convex portion $C_1$ of the magnetic metal member 143*a* has a substantially rectangular shape in section in the direction perpendicular to the axis of the magnet roller 133 and a broader width in a direction perpendicular to the axis or the longitudinal direction of the magnet roller 133 than that of the magnet body 141. The magnetic metal member 143*b* has two convex portions $C_2$, which are provided at an interval from each other in a width direction thereof and project toward the axis of the magnet roller 133. Each of the convex portions $C_2$ of the magnetic metal member 143*b* has a substantially rectangular shape in section in the direction perpendicular to the axis of the magnet roller 133.

Figure 6:
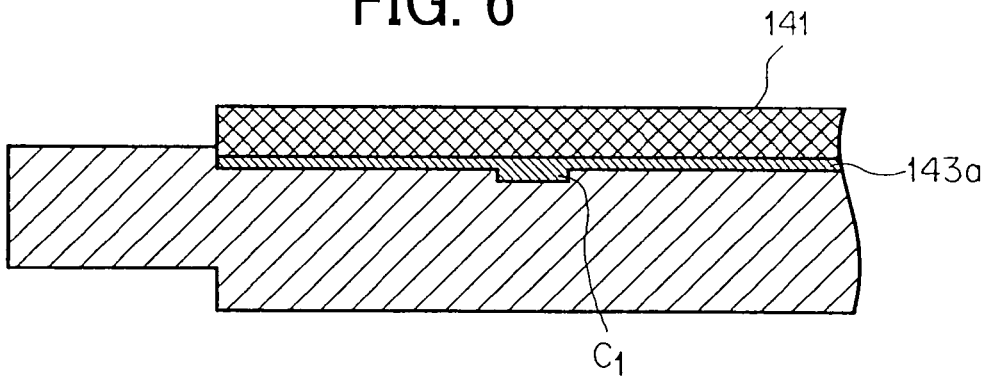
FIG. 6 is a sectional view showing the magnet roller of FIG. 5A.

Furthermore, as shown in FIG. 6 which is a schematic sectional view along line AA of FIG. 5A, the convex portion $C_1$ projecting toward the axis of the magnet roller 133 is provided at the center or a vicinity of the center in the longitudinal direction thereof on the long magnetic metal member 143*a*. The roller body 140 has a concave portion in which the above-mentioned convex portion $C_1$ is fitted. The convex portion $C_1$ is preferably provided at the center or the vicinity of the center in the longitudinal direction, but it is not limited thereto. The roller body 140 of the magnet roller 133 may be provided with a concave portion in which the two convex portions $C_2$ of the magnetic metal member 143*b* are fitted, as shown in FIG. 5B.

The roller body 140 may be obtained by an injection molding in which the long magnetic metal member is used as an insert. In this case, a die which is made of a magnetic material such as SKS3 is used. The magnetic metal member is set on a cavity in a state where a magnetic field is applied in one direction, and then the magnetic metal member is magnetically adsorbed to the die so that a position of the magnetic metal member is fixed and the roller body 140 of the magnetic roller integrally provided with the long magnetic metal member after being molded can be easily obtained. Consequently, the roller body 140 of the magnet roller 133 has magnetic anisotropy in the one direction.

The fixed magnetic poles of the magnet roller 133 are disposed to face the above-mentioned agitating screw 118. The fixed magnetic pole serves as a picking-up magnetic pole so that the picking-up magnetic pole generates a magnetic force on the outer surface of the development sleeve 132, that is to say, the development roller 115 to adsorb the developer contained in the second space 121 of the containing tank 117 onto the outer surface of the development sleeve 132.

At least one more fixed magnetic pole is provided between the above-mentioned picking-up magnetic pole and the aforementioned groove 142. The at least one more fixed magnetic pole generates a magnetic force on the outer surface of the development sleeve 132, that is to say, the development roller 116 to convey the developer before being developed onto the photoconductive drum 108.

The above-mentioned fixed magnetic poles and the magnet block 141 as the long magnet body adsorb the developer on the outer surface of the development sleeve 132, and then overlap the magnetic carrier 135 of the developer along magnetic field lines generated by the fixed magnetic poles to form raised portions or ears on the outer surface of the development sleeve 132. As mentioned above, the raised portions formed on the outer surface of the development sleeve 132 by overlapping the magnetic carrier 135 along the magnetic field lines are referred to as several standing portions of the magnetic carrier 135 on the outer surface of the development sleeve 132. The above-mentioned toner is adsorbed to the raised magnetic carrier 135, that is to say, the developer is adsorbed on the outer surface of the development sleeve 132 by the magnetic force of the magnetic roller 133.

The magnet block 141 is formed in a long rod-like shape. The magnet block 141 is buried in the groove 142 and fixed on an inner surface of the groove 142 with an adhesive, or the like so that the magnet block 141 is mounted on the roller body 140 of the magnet roller 133. The magnet block 141 linearly extends in the longitudinal direction of the roller body 140 and the magnet roller 133 and is provided along the entire length of the magnet roller 133.

Since the magnet block 141 is buried in the groove 142 to be mounted on the roller body 140 of the magnet roller 133, at this time, the magnet block 141 is lined with the long magnetic metal member so that it is hard to splinter and craze even when it is affected by thermal history or a shock is delivered in a handling operation. Accordingly, the durability is improved. The magnet block 141 is disposed to face the aforementioned photoconductive drum 108. The magnet block 141 serves as a development magnetic pole, and generates a magnetic force on the outer surface of the development sleeve 132, that is to say, the development roller 115 to form a magnetic field between the development sleeve 132 and the photoconductive drum 108. The magnet block 141 forms a magnet brush by the magnetic field so that the toner of the developer adsorbed on the outer surface of the development sleeve 132 is transferred to the photoconductive drum 108. As mentioned above, the magnet block 141 forms on the outer surface of the development sleeve 132 the development area 131 in which the toner of the developer adsorbed on the outer surface of the development sleeve 132 is transferred to the photoconductive drum 108.

Figure 17:
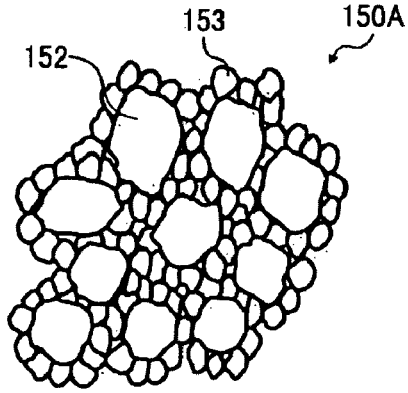
FIG. 17 is a schematic explanatory view illustrating a compression-molding magnet compound constituting the magnet roller shown in FIG. 6.
Figure 18:
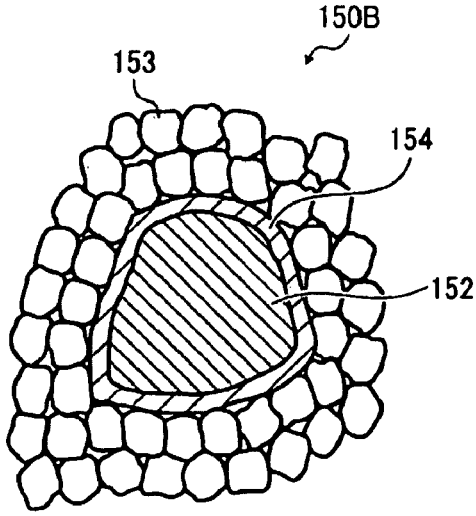
FIG. 18 is an enlarged schematic explanatory view illustrating a compression-molding magnet compound constituting the magnet roller shown in FIG. 6.
Figure 19:
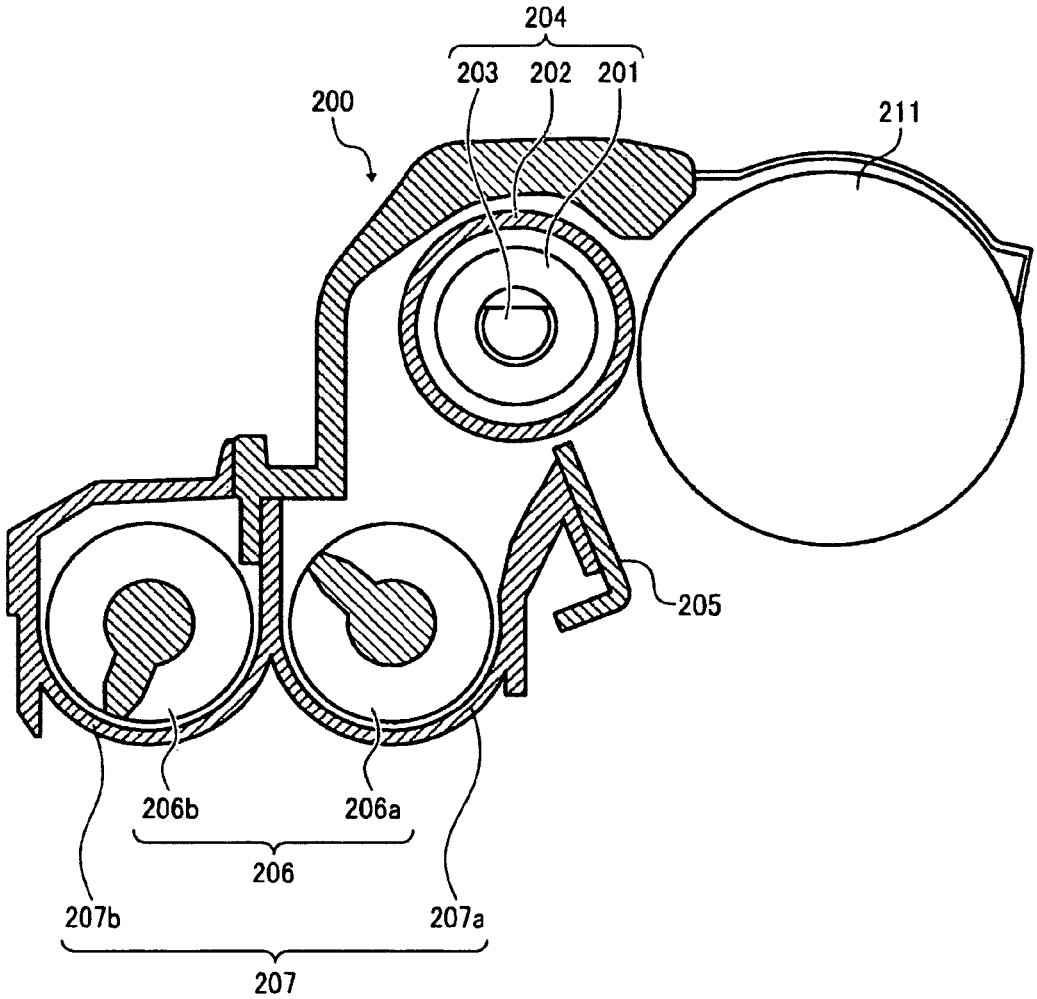
FIG. 19 PRIOR ART
FIG. 19 is a sectional view illustrating a conventional development device.

The magnet block 141 is obtained by a compression molding in which compression molding magnet compounds 150A and 150B, which are schematically shown in FIGS. 17 and 18, respectively, are filled in a press die and compression-molded under a magnetic field. That is to say, the magnet block 141 is obtained by the compression molding of the magnet compound 150A or 150B under the magnetic field. Since the above-mentioned compression molding can be performed when an amount of a binder resin is small, a composition rate of magnetic powder 151, as mentioned later, can be increased. Since molding density can be increased due to the compression molding, the method is excellent in achieving high magnetization.

The magnet compounds 150A, 150B have, as schematically shown in each of FIGS. 17 and 18, the magnetic powder 151 including magnetic particles (a magnetic particle) 152 and thermoplastic resin particles 153. The magnetic particles 152 are in a nonangular state and have a mean diameter of about 80 to 150 μm. In the compression molding magnet compound 150B, at least a part of an outer surface of the magnetic particle 152 has a covered layer 154, which is constituted of a polyurethane resin or a condensed cross-linked product made of a polyurethane resin and amino resin.

Thereby, since the compression-molding magnet compounds 150A, 160B have the magnetic powder 151 and the thermoplastic resin particle 153, when agitating and mixing the magnetic particles 152 and the thermoplastic resin particles 153, the magnetic particles 152 are positively-charged by frictional charge and the thermoplastic resin particles 153 are negatively-charged. Accordingly, the thermoplastic resin particles 153 are attached to the surfaces of the magnetic particles 152 by an electrostatic adherent force so that the magnetic particles 152 in the molded magnet block 141 are effectively oriented to improve magnetic property of the magnet block 141.

Furthermore, as the compression-molding magnet compounds 150B schematically shown in FIG. 18, since at least one part of the surface of the magnetic particles 152 has the polyurethane resin or the covered layer 154 constituted by the condensed cross-linked product made of the polyurethane resin and the amino resin, the thermoplastic resin particles 153 are easily negatively charged as well as the polyurethane resin or the condensed cross-linked product being easily positively charged. Therefore, the electrostatic adherent force between the thermoplastic resin particles 153 and the polyurethane resin or the condensed cross-linked product made of the polyurethane resin and the amino resin becomes large. Due to a load applied when the die is filled with the compression-molding magnet compounds 150B, no thermoplastic resin particles 153 are isolated and splashed. Accordingly, the magnetic particles 152 in the oriented magnetic field are strongly oriented to improve magnetic properties of the magnet block 141 as well as to reduce variation of magnetic flux density of the magnet block 141 so that reduction of the magnetic force due to a thermal effect in the compression molding is controlled.

The blending ratio of the magnetic powder 151 in the compression molding magnet compounds 150A, 150B is preferably about 90 to 99 wt % (weight %), more preferably 92 to 97 wt %. If a contained amount of the magnetic powder 151 is too small, the magnetic properties are not improved, and if the contained amount of the magnetic powder 151 is too large, since a contained amount of the binder resin is insufficient, moldability of the magnet block 141 is reduced and cracks or the like occur.

Figure 16:
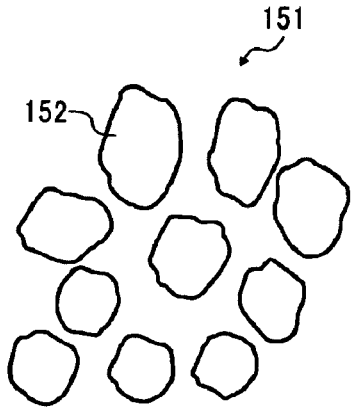
FIG. 16 is a schematic view illustrating magnetic powder constituting the magnet roller shown in FIG. 6.

As schematically shown in FIG. 16, the magnet powder 151 includes the nonangular magnetic particles 152 having a mean diameter of 80 to 150 μm. The bulk density of the magnetic powder 151 is adjusted between 3.3 g/cm$^3$ to 4.0 g/cm$^3$. Here, the bulk density is obtained as follows. A metal container having a volume of 100 cc is filled and heaped with the magnetic powder of 485 g through an infundibulum, and then the magnetic powder is struck along an opening plane of the container. The weight of the magnetic powder remaining in the container is measured and then the weight of the magnetic powder divided by the volume of the container, that is 100 cc is the bulk density.

As mentioned above, since the magnetic powder 151 includes the nonangular magnetic particles 152 and the bulk density of the magnetic powder 151 is adjusted between 3.3 g/cm$^3$ to 4.0 g/cm$^3$, the magnet block 141 which has a high magnetic force and in which the variation of the magnetic flux density is reduced can be obtained by the compression molding.

The magnetic powder 151 which has the bulk density adjusted in a range from 3.3 g/cm$^3$ to 4.0 g/cm$^3$ is formed by collision between angular magnetic particles 152 or between the angular magnetic particles 152 and particles (not shown) which are made of a more rigid material than the angular magnetic particles 152. In this case, the magnetic particles 151 having angles before preparation are easily rounded off to be nonangular and in a spherical state (see FIG. 16) so that the magnetic powder having the bulk density of 3.3 g/cm$^3$ to 4.0 g/cm$^3$ can be obtained even if the bulk density of the magnetic powder before preparation is less than 3.3 g/cm$^{-3}$.

Since the magnetic particles 152 of the mean diameter of 80 to 150 μm have a large contact area therebetween, the magnetic powder 151 has a large bulk density. The inventors found out that there is a close relationship between the bulk density of the magnetic powder 151 and the magnetic flux density of the magnet block 141 and that the magnetic flux density of the magnet block 141 increases as the bulk density increases. The molding density of the magnetic block 141 can be increased when the magnetic block 141 is formed by closely filling the die with the magnetic particles 152 having the mean diameter of 80 to 150 μm. Since each magnetic particle 152 has a generally spherical form, rotation of the magnetic powder 151 when the magnetic field is oriented is prevented from being inhibited and then magnetizing axes of easy magnetization are easily oriented uniformly. Accordingly, the magnetic flux density of the magnet block 141 increases as the bulk density increases. When the bulk density of the magnetic powder 151 is less than 3.3 g/cm$^3$, predetermined high magnetic flux density can not be obtained and the present technology can not provide the magnetic powder 151 having the bulk density of more than 4.0 g/cm$^3$. Accordingly, when the bulk density of the magnetic powder 151 is between 3.3 g/cm$^3$ and 4.0 g/cm$^3$, the predetermined high magnetic flux density can be obtained.

Generally, re-milling of the magnetic powder 151 is performed by use of a mill such as an Attritor mill, a Jet mill, or the like, or a mixer such as a Henschel mixer. However, since these mills or mixers used for re-milling may crush the magnetic particles 152 of the magnetic powder 161 into particles which are too small, the mean diameter of the magnetic particles 152 becomes too small. It is not preferable that the mean diameter of the magnetic particles 152 be excessively small because the magnetic properties are reduced. Since an amount of fine powder increases due to the re-milling, flow property of the magnetic powder 151 is reduced and therefore filling property of the magnetic powder in the die is reduced. In order to improve the density of the magnetic powder 151 while preventing the above problems, a tabular mixer, as used in the present invention is advantageously used to mix the magnetic particles 152 with each other, or the magnetic particles 152 and an admixture of media. Although a true specific gravity of rare earth magnetic powder is about 7.5 g/cm$^3$, as a theoretical upper limit, the present technology can not provide a true specific gravity of more than 4.0 g/cm$^3$.

The magnetic powder 151 is formed of the magnetic particles 152 made of a rare earth magnetic material which can have high productivity of increasing magnetic force (13 MGOe or more). The rare earth magnetic material is preferably a material made of an alloy including a rare-earth element and a transition metal, for example, the following (1) to (3), particularly (1).

(1) A material principally including R (at least one of rare-earth elements having Y), a transition metal which is principally made of Fe, and B, that is to say, a material which is referred to as R—Fe—B alloy. Representative examples are Nd—Fe—B alloy, Pr—Fe—B alloy, Nd—Pr—Fe—B alloy, Ce—Nd—Fe—B alloy, Ce—Pr—Nd—Fe—B alloy, and one of these alloys, in which a part of Fe is replaced by another transition metal, such as Co, Ni, or the like.

(2) A material principally including a rare-earth element which is principally made of Sm, and a transition metal which is principally made of Co, that is to say, a material which is referred to as Sm—Co alloy. Representative examples are $SmCo_5$, $Sm_2TM_{17}$ (TM is a transition metal), and the like.

(3) A material principally including a rare-earth element which is principally made of Sm, a transition metal which is principally made of Fe, and an interstitial element which is principally made of N, that is to say, a material which is referred to as Sm—Fe—N alloy. A representative example is $Sm_2Fe_{17}N_3$, which is obtained by azotizing $Sm_2TM_{17}$ alloy.

The above rare-earth element may be, for example, Y, La, Ce, Pr, Nd, Pm, Sm, Eu, Gd, Tb, Dy, Ho, Er, Tm, Yb, Lu, a mischmetal, or the like or a combination of one or more of the above rare-earth elements. The above transition metal may be Fe, Co, Ni, or the like, or a combination of one or more of the above transition metals. In addition, in order to improve the magnetic property, the magnetic powder 151 may include B, Al, Mo, Cu, Ga, Si, Ti, Ta, Zr, Hf, Ag, Zn, or the like, as needed.

A volume mean diameter of the magnetic particles 152 constituting the magnetic powder 151 is preferably 80 to 150 μm, more preferably 90 to 140 μm. The mean diameter is measured by DRY unit of Mastersizer 2000 (Sysmex Corp.).

As schematically shown in FIG. 18, at least a part of the surface of the magnetic particle 152 which constitutes the magnetic powder 151 has the covered layer 154 made of the polyurethane resin or the condensed cross-linked compounds made of the polyurethane resin and the amino resin. Thereby, in the compression molding compound 150B, the polyurethane resin or the condensed cross-linked compound made of the polyurethane resin and the amino resin is easily positively charged so that the magnetic particles 152 are strongly electrostatically-attached to the thermoplastic resin particles 153 as the binder resin. Accordingly, due to the load applied when filling the compression molding magnet compound 150B in the die, the thermoplastic resin particles 153 are prevented from being isolated and splashed.

A mean diameter of the thermoplastic resin particles 153 in the compression molding magnet compounds 150A, 150B is preferably 1/10 or less of the mean diameter of the magnetic particles 152 of the magnetic powder 151. Thereby, it is possible to increase the molding density of the magnet body so that the magnetic property is improved.

The thermoplastic resin particles 153 in the compression molding magnet compounds 150A, 150B, are preferably spherical particles produced by the emulsion polymerization or the suspension polymerization. Thereby, it is possible to provide a highly densified compression molding so that the magnetic property is further improved. In addition, since a cover area to the magnetic powder is improved due to the spherical shape of the particles, an exposed area of the magnetic powder on the magnet body surface can be reduced and a rusting prevention effect is provided.

The thermoplastic resin constituting the thermoplastic resin particles 153 may be, for example, styrene homopolymers such as polystyrene, poly chlorostyrene, polyvinyl toluene and substitution products thereof; and styrene copolymers such as styrene-p-chlorostyrene copolymer, styrene-propylene copolymer, styrene-vinyltoluene copolymer, styrene-vinyl naphthalene copolymer, styrene-methyl acrylate copolymer, styrene ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile indene copolymer, styrene-maleic acid copolymer, and styrene-maleic ester copolymer, and the like. Moreover, the aforementioned thermoplastic resin may also be polymethyl methacrylate, polybutyl methacrylate, polyvinyl chloride, polyvinyl acetate, polyethylene, polypropylene, polyester, polyvinyl butyral, polyacrylic resin, rosin, modified rosin, terpene resin, phenol resin, epoxy polyol resin, or the like. These resins are used in combination of one or more resins.

The thermoplastic resin particles 153 are, as mentioned above, used as a binder resin and the binder resin is prepared, for example, as follows. A charge controlling agent (CCA), a pigment, and an agent having a low softening point, such as a wax are mixed and dispersed in a thermoplastic resin such as polyester, polyol, or the like, and a mold releasing agent such as silica, titanium oxide, and the like is added to a surrounding part of the resin to improve the flowability. An additive amount of the pigment is 1 to 20 wt %, preferably 5 to 10 wt %. The charge controlling agent is added to improve the dispersibility of the magnetic particles and the thermoplastic resin particles. An additive amount of the charge controlling agent is 0.1 to 20 wt %, preferably 0.5 to 10 wt %. The mold releasing agent is added to improve mold releasing property after molding. An amount of the mold releasing agent is 1 to 20 wt %, preferably 2 to 10 wt %. Since the thermoplastic resin particles 153 are easily negatively charged and have excellent flowability, the thermoplastic resin particles 153 have excellent electrostatic adherence to the magnetic powder to enable spaces between the magnetic particles to be filled up.

In the thermoplastic resin particles 153, examples of the additive are, for example, metal oxide such as aluminium oxide, titanium oxide, strontium titanate, cerium oxide, magnesium oxide, chrome oxide, tin oxide, zinc oxide, or the like, nitride such as silicon nitride, or the like, carbide such as silicon carbide, or the like, metallic salt such as calcium sulfate, barium sulfate, calcium carbonate, or the like, fatty acid metallic salt such as zinc stearate, calcium stearate, or the like, carbon black, and silica. A diameter of the additive is normally in a range from 0.1 to 1.5 μm, and an amount of the additive is preferably 0.01 to 10 parts by weight in relation to 100 parts by weight before being added, more preferably 0.05 to 5. The additive may be used solely or plural additives may be used. These additives are preferably hydrophobized.

The pigment may be, for example, carbon black, lampblack, magnetite, black titanium oxide, chrome yellow, ultramarine blue, aniline blue, phthalocyanine blue, phthalocyanine green, Hansa yellow G, Rhodamine 6G, Calco Oil blue, quinacridone, benzidine yellow, rose bengal, malachite green lake, quinoline yellow, C.I. Pigment red 48:1, C.I. Pigment red 122, C.I. Pigment red 57:1, C.I. Pigment red 184, C.I. Pigment yellow 12, C.I. Pigment yellow 17, C.I. Pigment yellow 97, C.I. Pigment yellow 180, C.I. solvent yellow 162, C.I. Pigment blue 5:1, C.I. Pigment blue 15:3, carmine, and the like.

In addition, an agent having a low softening point can be included in the thermoplastic resin particles 153. The agent having the low softening point may be, for example, paraffin wax, polyolefin wax, Fischer-Tropsch wax, amide wax, higher fatty acid, ester wax and derivatives thereof, or graft-block compounds, or the like. Such an additive amount of an agent having the low softening point is preferably about 5 to 30 percents by mass.

The magnet block 141 in which maximum magnetic flux density is 100 to 130 mT has a greater ability to increase the magnetic force (13 to 16 MGOe) than that of a conventional plastic magnet, in which maximum magnetic flux density is 80 to 120 mT.

The development sleeve 132 of the development device according to present invention contains or houses the magnet roller 133 and is rotatably provided about the axis. The development sleeve 132 is rotated such that the inner surface of the development sleeve 132 faces the fixed magnetic poles in order. As mentioned above, the outer surface of the development sleeve 132 is processed by a roughening process with the surface processing device 1.

Figure 7:
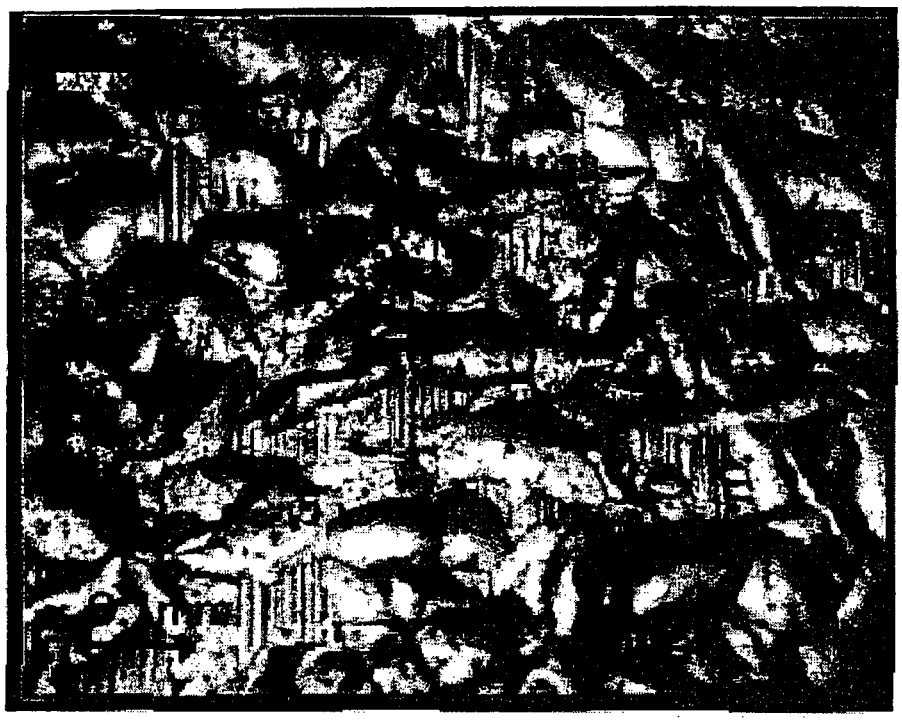
FIG. 7 is a micrograph in which an outer surface of the development sleeve shown in FIG. 4 is enlarged.
Figure 8:
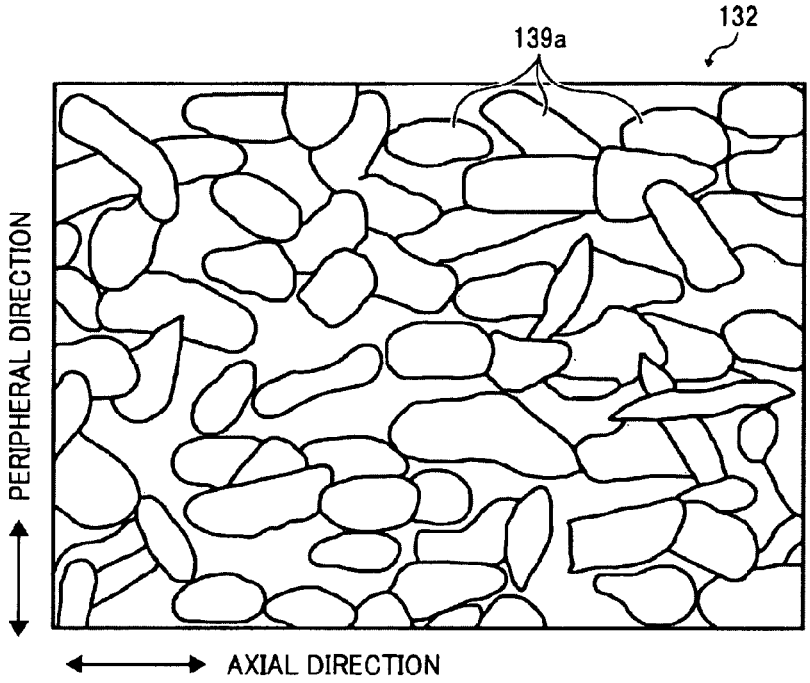
FIG. 8 is an explanatory view clearly illustrating a state of the outer surface of the development sleeve by tracing the micrograph shown in FIG. 7.

In addition, on the outer surface of the development sleeve 132, as shown in FIGS. 7 and 8, a plurality of depressions 139 which are formed in a generally elliptical shape in plane view are provided. The depressions 139 are randomly disposed on the outer surface of the development sleeve 132. The depressions 139 include depressions each having a longitudinal direction along the axial direction of the development sleeve 132 and depressions each having a longitudinal direction along the peripheral direction of the development sleeve 132. There are more depressions 139 having the longitudinal direction along the axial direction of the development sleeve 132 than the depressions 139 having the longitudinal direction along the peripheral direction of the development sleeve 132. Furthermore, a length of the depressions 139 in the longitudinal direction (major axis) is 0.05 mm or more and 0.3 mm or less, and a length of the depressions 139 in a width direction (minor axis) is 0.02 mm or more and 0.1 or less. In FIGS. 7 and 8, right and left directions mean the axis direction of the development sleeve 132.

The control blade 116 is provided on an end of the development device 113, which is disposed close to the photoconductive drum 108. The control blade 116 is mounted on the above-mentioned case 125 with an interval from the outer surface of the development sleeve 132. The control blade 116 scrapes the developer on the outer surface of the development sleeve 132, which has a thickness over a desirable value, into the containing tank 117 so that the developer on the outer surface of the development sleeve 132, which is conveyed to the development area 131, is set in the desirable thickness.

The development device 113 configured as mentioned above agitates the toner and the magnetic carrier 136 in the developer supplying portion 114 for preparing the developer, and the agitated developer is adsorbed to the outer surface of the development sleeve 132 by the plurality of fixed magnetic poles. Then, the development device 113 conveys the adsorbed developer by the plurality of fixed magnetic poles toward the development area 131 while the development sleeve 132 is rotated. The development device 113 causes the developer, which is set to the desirable thickness by the control blade 116, to be adsorbed on the photoconductive drum 108. Thereby, the development device 113 causes the developer to be supported on the development roller 115 and to be conveyed to the development area 131, in order to develop the electrostatic latent image formed on the photoconductive drum 108 to form the toner image.

The development device 113 allows the developed developer to be left toward the containing tank 117. In addition, the developed developer, which is contained in the containing tank 117, is sufficiently agitated again with another developer in the second space 121 to be used for development of another electrostatic latent image formed on the photoconductive drum 108.

The image forming apparatus 101 configured as mentioned above forms an image on the recording paper 107 as follows. At first, the image forming apparatus 101 rotates the photoconductive drum 108 and charges uniformly the outer surface of the photoconductive drum 108 by the charged roller 109. The outer surface of the photoconductive drum 108 is irradiated with a laser to form the electrostatic latent image thereon. Then, after the electrostatic latent image is positioned at the development area 131, the developer adsorbed on the outer surface of the development sleeve 132 of the development device 113 is adsorbed on the outer surface of the photoconductive drum 108, the electrostatic latent image is developed, and then the toner image is formed on the outer surface of the photoconductive drum 108.

The image forming apparatus 101 causes the recording paper 107 conveyed by the paper supplying roller 124 of the paper supplying unit 103, or the like to be positioned between the photoconductive drum 108 of each of the process cartridges 106Y, 106M, 106C, and 106K and the conveying belt 129 of the transfer unit 104 so that the toner image formed on the outer surface of the photoconductive drum 108 is transferred on the recording paper 107. The image forming apparatus 101 fixes the toner image on the recording paper 107 at the fixing unit 105. As mentioned above, the image forming apparatus 101 forms a color image on the recording paper 107.

Figure 10:
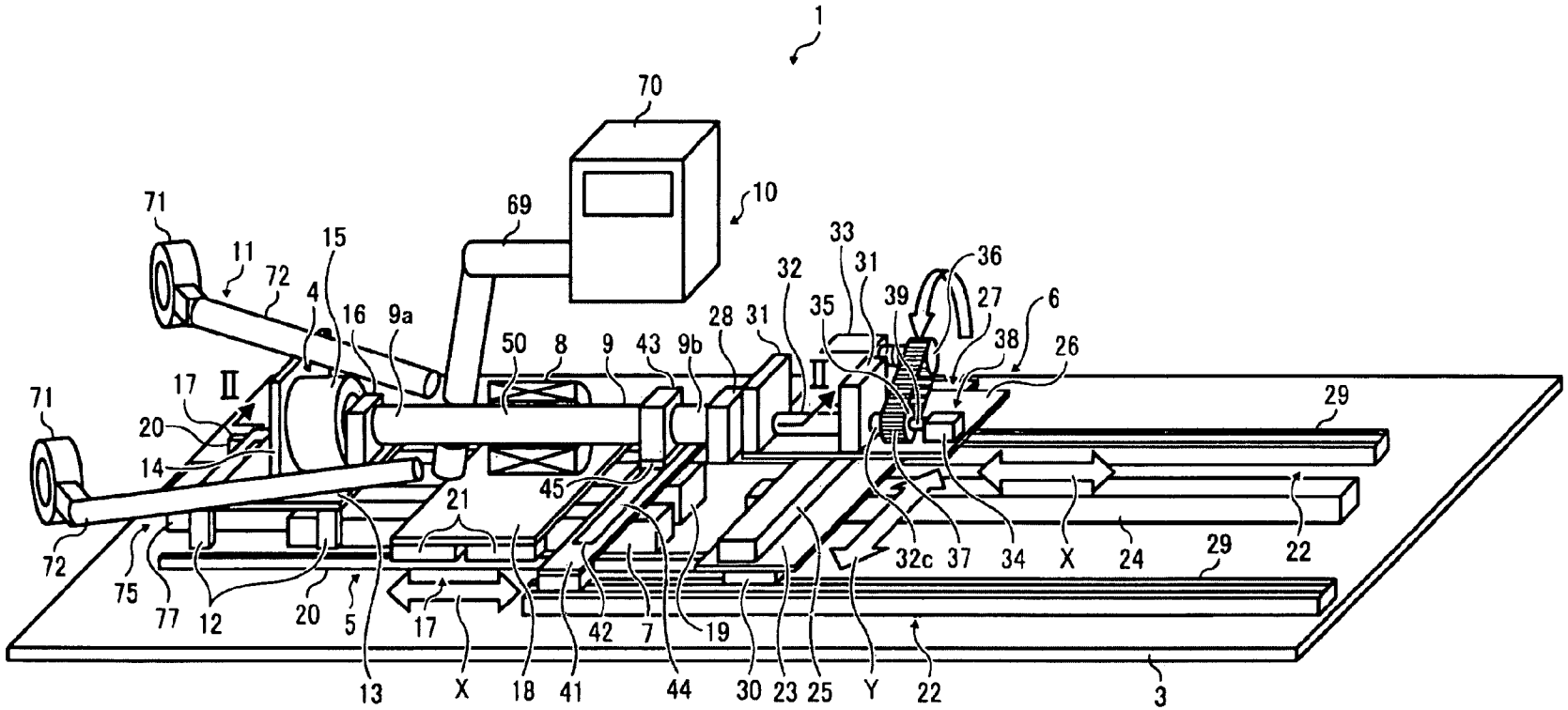
FIG. 10 is a schematic view illustrating a surface processing device which performs a surface roughening process on the outer surface of the development sleeve shown in FIG. 4.
Figure 11:
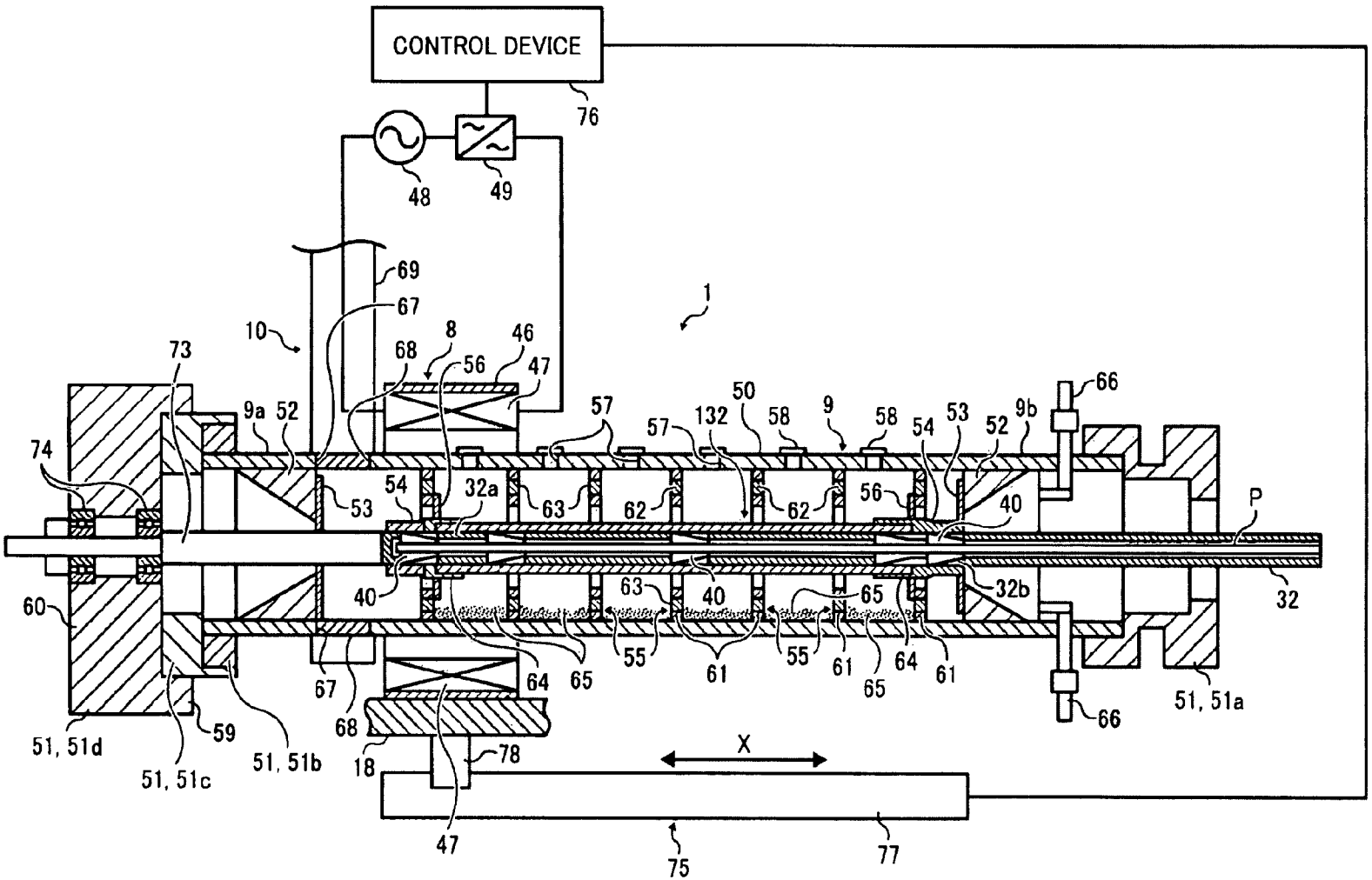
FIG. 11 is a schematic sectional view illustrating the surface processing device along line II-II of FIG. 10.

A surface roughening treatment is performed on the outer surface of the above-mentioned development sleeve 132 by a surface treatment device 1 shown in FIGS. 10 and 11.

The surface treatment device 1 includes a base 3, a fixing holding portion 4, a moving electro-magnetic coil portion 5 as a moving device, a moving holding portion 6, a moving chuck portion 7, an electro-magnetic coil 8 as a magnetic field generating device, and a containing tank 9, a collection portion 10, a cooling portion 11, a linear encoder 75 as a detection device, and a control device 76 as a control device (see FIG. 11 as a schematic sectional view along line II-II of FIG. 10).

The base 3 is formed in a tabular shape and mounted on a floor of a factory, on a table, and so on. An upper surface of the base 3 is maintained parallel to a horizontal direction. The base 3 is formed in a rectangular shape in plane view.

The fixing holding portion 4 includes a plurality of supports 12 raised from an end of the base 3 in a longitudinal direction (hereinafter, shown by an arrow X), a holding base 13, a standing mounted bracket 14, a cylindrical holding member 15, and a holding chuck 16.

The holding base 13 is formed in a tabular shape and mounted on a top of the support 12. The standing mounted bracket 14 is formed in a tabular shape and raised from the holding base 13. The cylindrical holding member 15 is formed in a cylindrical shape and mounted on the standing mounted bracket 14 and the holding base 13. The cylindrical holding member 15 is disposed such that an axis thereof is parallel to both of a horizontal direction and the arrow X, and is situated nearer the central portion of the base 3 in relation to the standing mounted bracket 14. The cylindrical holding member 15 contains inside the below-mentioned flange members 51*b*, 51*c*, 51*d* (that is, an end 9*a*) which are mounted on the end 9*a* of the containing tank 9.

The holding chuck 16 is disposed near the above-mentioned cylindrical holding member 15, that is the holding bass 13, and mounted on the above-mentioned base 3. The holding chuck 16 chucks the containing tank 9, which has the end 9*a* contained in the cylindrical holding member 15, to hold the end 9*a* of the containing tank 9. The fixing holding portion 4 configured as mentioned above holds the end 9*a* of the containing tank 9.

The moving electro-magnetic coil portion 5 includes a pair of linear guides 17, an electro-magnetic coil holding base 18, and a driving electro-magnetic coil actuator 19. Each of the linear guides 17 includes a rail 20 and a slider 21. The rail 20 is mounted on the base 3. The rail 20 is formed in a linear shape and disposed such that a longitudinal direction of the rail is parallel to the longitudinal direction of the base 3, that is, the arrow X. The slider 21 is movably supported on the rail 20 along the longitudinal direction of the rail 20, that is to say, the arrow X. The pair of linear guides 17 are disposed with an interval from each other as the rail 20 moves along a width direction (hereinafter, shown by an arrow Y) of the base 3. In addition, the arrow X and the arrow Y are in a direction perpendicular to each other, and are parallel to the horizontal direction.

The electro-magnetic coil moving base 18 is formed in a tabular shape and mounted on the above-mentioned slider 21. An upper surface of the electro-magnetic coil holding base 18 is disposed in a parallel to the horizontal direction. The electro-magnetic coil 18 is mounted on an outer surface of the electro magnetic coil holding base 18. The moving electro magnetic coil actuator 19 is mounted on the base 3, and moves to slide the above-mentioned electro-magnetic coil holding base 18 along the arrow X. The above-mentioned electro-magnetic coil moving portion 5 moves to slide the electro-magnetic coil holding base 18, that is to say, the electro-magnetic coil 8 along the arrow Y by the moving electro-magnetic coil actuator 19. Moreover, a moving velocity of the electro-magnetic coil 8 by the electro-magnetic coil moving portion 5 can be modified ranging within from 0 mm/s to 300 mm/s. In addition, a moving range of the electro-magnetic coil 8 of the electro-magnetic coil moving portion 5 is about 600 mm.

The moving holding portion 6 includes a pair of linear guides 22, a holding base 23, a first actuator 24, a second actuator 25, a moving base 26, a roller bearing rotational base 27 and a holding chuck 28.

Each of the linear guides 22 includes a rail 29 and a slider 30. The rail 29 is provided on the base 3. The rail 29 is formed in a linear shape and disposed such that a longitudinal direction of the rail 29 is parallel to the longitudinal direction of the base 3. The slider 30 is movably supported on the rail 29 along the longitudinal direction of the rail 29, that is to say, the arrow X. The rails 29 of the pair of linear guides 22 are disposed with an interval in a direction of the arrow Y, that is to say, a width direction of the base 3 from each other.

The holding base 23 is formed in a tabular shape and mounted on the above-mentioned slider 30. The upper surface of the holding base 23 is disposed parallel to the horizontal direction. The first actuator 24 is mounted on the base 3 and moves to slide the above-mentioned holding base 23 along the arrow X.

The second actuator 25 is mounted on the holding base 28 and moves to slide the moving base 26 along the arrow Y. The moving base 26 is formed in a tabular shape and an upper surface of the moving base 26 is disposed parallel to the horizontal direction.

The roller bearing rotational portion 27 includes a pair of roller bearings 31, a midair holding member 32 as an axis, a driving motor 33 as a rotating device, and a chuck cylinder 34. The pair of roller bearings 31 are disposed along the arrow X with an interval from each other and mounted on the moving base 26. The midair holding member 32 is comprised of a magnetic material, formed in a cylindrical shape, and supported rotatably about the axis by the above-mentioned roller bearings 31. The axis of the midair holding member 32 is disposed parallel to the above-mentioned arrow X, that is to say, the axis of the cylindrical holding member 15 of the fixing holding portion 4. The midair holding member 32 is disposed in a form to be projected from an upside of the moving base 26 toward the fixing holding portion 4 such that an end 32*a* of the midair holding member 32 is positioned in the containing tank 9, and such that another end 32*c* of the midair holding member 32 is positioned on an upside of the moving base 26. The midair holding member 32 passes through the cylindrical development sleeve 132 as shown in FIG. 2. In addition, a pulley 35 is fixed on the other end 32*c* positioned on the moving base 26 of the midair holding member 32. The pulley 35 is disposed in a coaxial state with the midair holding member 32.

The driving motor 33 is mounted on the moving base 26 and a pulley 36 is mounted on an output axis of the driving motor 33. An axis of the output axis of the driving motor 33 is parallel to the arrow X. An endless timing belt 37 is tacked across the above-mentioned pulleys 35, 36. The driving motor 33 rotates the midair holding member 32 about an axis thereof. The driving motor 33 rotates the development sleeve 132 about the axis of the midair holding member 32 which is parallel to the longitudinal direction of the containing tank 9, that is the axis of the development sleeve 132 by rotating the midair holding member 32 about the axis thereof.

The chuck cylinder 34 includes a cylinder body 38, which is provided on the moving base 26, and a chuck shaft 39, which is slidably provided on the cylinder body 38. The chuck shaft 39 is formed in a cylindrical shape and disposed in a longitudinal direction of the chuck shaft 39 parallel to the arrow X. The chuck shaft 39 is contained in the midair holding member 32 and disposed in a coaxial state with the midair holding member 32. A plurality of pairs of chuck claws 40 are mounted on the chuck shaft 39.

The pair of chuck claws 40 are mounted on the chuck shaft 39 in a projected state from an outer surface of the chuck shaft 39 toward a circumferential side of the chuck shaft 39. The chuck claws 40 are capable of being projected from the outer surface of the midair holding member 32 toward the circumferential side of the midair holding member 32. The chuck claws 40 are provided to be capable of modifying a length of a projected part from the chuck shaft 39 and the midair holding member 32. The plurality of pairs of chuck claws 40 are disposed along the longitudinal direction of the above-mentioned chuck shaft 39, that is to say, the arrow X with intervals from each other. An amount of the length of the part projected from the above-mentioned chuck shaft 39 and the midair holding member 32 increases as the chuck shaft 39 of the chuck cylinder 34 contracts to be close to the cylinder body 38.

The above-mentioned chuck cylinder 34 causes the chuck claws 40 to be projected more to the circumferential side of the chuck shaft 39 as the chuck shaft 39 contracts the cylinder body 38. Thereby, the chuck shaft 39 is compressed onto an inner circumference of the development sleeve 132 mounted on the outer surface of the midair holding member 32, and then the chuck claws 40, the midair holding member 32, and the development sleeve 132 are fixed. Here, the chuck shaft 39, the midair holding member 32, the development sleeve 132, and a below-mentioned cylindrical member 50, that is, the containing tank 9 are in a coaxial state with each other.

In other words, the above-mentioned chuck cylinder 34 fixes the chuck shaft 39, the midair holding member 32, and the development sleeve 132 by compressing the chuck claws 40 onto the inner circumference of the development sleeve 132 mounted on the outer circumference of the midair holding member 32.

The above-mentioned chuck cylinder 34 and the chuck claws 40 support the development sleeve 132 so as to be in a coaxial state with the midair holding member 32 and the containing tank 9. That is, the chuck cylinder 34 and the chuck claws 40 support the development sleeve 132 at a center of the containing tank 9. The above-mentioned chuck cylinder 34, the chuck claws 40 and the midair holding member 32 serve as a holding device.

The holding chuck 28 is disposed on the above-mentioned moving base 26. The holding chuck 28 chucks the mentioned-below flange member 51*a* which is mounted on an end 9*b* of the containing tank 9 to hold the end 9*b* of the containing tank 9. The holding chuck 28 controls rotation of the containing tank 9 about the axis thereof.

The moving holding portion 6 configured as mentioned above moves the holding chuck 28, the midair holding member 32, and the like along the arrows X and Y perpendicular to each other by the actuators 24, 25. That is, the moving holding portion 6 moves the containing tank 9 held by the holding chuck 6 along the arrows X and Y.

The moving chuck portion 7 includes a holding base 41, a linear guide 42, and a holding chuck 43. The holding base 41 is fixed on an end of the rail 29 of the linear guide 22, which is close to the fixing holding portion 4. The holding base 41 is formed in a tabular shape and has an upper surface, which is disposed parallel to the horizontal direction.

The linear guide 42 includes a rail 44 and a slider 45. The rail 44 is mounted on the holding base 41. The rail 44 is formed in a linear shape and disposed such that a longitudinal direction of the rail 44 is parallel to the arrow Y, that is to say, a width direction of the base 3. The slider 45 is movably supported on the rail 44 along the arrow Y, that is to say, the longitudinal direction of the rail 44.

The holding chuck 43 is mounted on the slider 45. The holding chuck 43 is positioned between the above-mentioned holding chucks 16 and 28. The holding chuck 43 chucks a part of the containing tank 9, which is close to the other end 9*b* of the containing tank 9, to hold the containing tank 9. The holding chuck 43 holds the containing tank 9 so that the above-mentioned moving chuck portion 7 allows the containing tank 9 to be positioned. In addition, the holding chuck 43 holds the containing tank 9 so that the moving chuck portion 7 holds the containing tank 9 to prevent the containing tank 9 from separating from the roller bearing rotational portion 27, that is to say, the surface treatment device 1 in cooperation with the above-mentioned holding chuck 28 when the containing tank 9 moves along the axis thereof.

The electro-magnetic coil 8 includes an outer coat 46 formed in a cylindrical shape and a plurality of coil portions 47 disposed in the outer coat 46, and is formed in an annular shape entirely, as shown in FIG. 11. An inner diameter of the electro-magnetic coil 8 is larger than an outer diameter of the containing tank 9. That is, a space is formed between an inner circumferential surface of the electro-magnetic coil 8 and an outer surface of the containing tank 9. In addition, an entire length of the electro-magnetic coil 8 in an axis direction is sufficiently shorter than an entire length of the containing tank 9 in an axis direction. Moreover, it is preferable that the entire length of the electro-magnetic coil 8 in the axis direction be ⅔ or less of the entire length of the containing tank 9 in the axis direction. In the illustrated embodiments, the inner diameter of the electro-magnetic coil 8 is 90 mm and the length of the electro-magnetic coil 8 in the axis direction is 85 mm.

The outer coat 46 is mounted on the above-mentioned electro-magnetic coil holding base 18 in a state where an axis of the outer coat 46, that is to say, of the electro-magnetic coil 8 itself is parallel to the arrow X. The electro-magnetic coil 8 is disposed in a coaxial state with the midair holding member 32, the chuck shaft 39, and the containing tank 9. The plurality of coil portions 47 are disposed in parallel along a circumference direction of the outer coat 46, that is to say, the electro-magnetic coil 8. The coil portions 47 are applied with a three-phase alternating-current source 48 shown in FIG. 11. An electrical power which has phases, which are deviated from each other, is applied to the plurality of coil portions 47, and the plurality of coil portions 47 generates magnetic fields, which have phases deviated from each other. Then, the electro-magnetic coil 8 generates a magnetic field (rotational magnetic field) rotating in a rotational direction about an axis of the electro-magnetic coil 8, which is formed by combining these magnetic fields, in an inner side of the electro-magnetic coil 8.

The above-mentioned electro-magnetic coil 8 is applied with the three-phase alternating-current source 48 to generate the rotational magnetic field and to be moved by the electro-magnetic coil moving portion 5 along the longitudinal direction of the containing tank 9. Then, the electro-magnetic coil 8 positions wire members 65 contained in the containing tank 9 in the outer circumference of the development sleeve 132 by the above-mentioned rotational magnetic field and rotates (moves) the wire members 65 about the axis of the containing tank 9 and the development sleeve 132. And then, the electro-magnetic coil 8 hits the wire members 65 moved by the above-mentioned rotational magnetic field on the outer surface of the development sleeve 132.

Moreover, an inverter 49 as a magnetic field modifying device is provided between the three-phase alternating-current source 48 and the electro-magnetic coil 8. That is, the surface treatment device 1 includes the inverter 49 as the magnetic field modifying device. The inverter 49 is capable of modifying a frequency, a current value, and a voltage value of the electrical power applied by the three-phase alternating-current source 48 on the electro-magnetic coil 8. The inverter 49 increases or decreases the electrical power applied by the three-phase alternating-current source 48 on the electro-magnetic coil 8 to modify an intensity of the rotational magnetic field generated by the electro-magnetic coil 8 by modifying the frequency, the current value, and the voltage value of the electrical power applied to the electro-magnetic coil 8.

The containing tank 9 includes the cylindrical member 50 which has an outer wall formed in a single structure (that is, the outer wall is formed by a single wall), a plurality of flange members 51, a pair of lopped waste sealing holders 52, a pair of lopped waste sealing blades 53, a pair of position members 54, the plurality of partition members 55 as a partition device, and a pair of sealing blades 56 as shown in FIG. 11.

The cylindrical member 50 is formed in a cylindrical form and serves as an outer shell of the containing tank 9. Thereby, the containing tank 9 is formed in a single structure so that the outer wall of the cylindrical member 50 is formed in a single structure as well as in a cylindrical shape. It is preferable that an outer diameter of the cylindrical member 50, that is to say, of the containing tank 9 be about from 40 mm to 80 mm. Moreover, it is preferable that a wall thickness of the cylindrical member 50 be about from 0.5 mm to 2.0 mm. It is preferable that a length of the cylindrical member 50 in an axis direction be about from 600 mm to 800 mm. The cylindrical member 50 is formed of non magnetic materials.

A plurality of grain supplying holes 57 are provided on the cylindrical member 50. The grain supplying hole 57 penetrates through the cylindrical member 50 to communicate with an inside and an outside of the cylindrical member 50. A sealing cap 58 is mounted on the grain supplying hole 57. The grain supplying hole 57 allows the wire members 65 to pass into an inside thereof, and takes the wire members 65 in and out of the cylindrical member 50, that is to say, the containing tank 9. In addition, the sealing cap 58 blocks or caulks the grain supplying hole 57 and controls the wire members 65 to flow out of an outside of the cylindrical member 50, that is to say the containing tank 9.

The plurality of flange members 51 is formed in an annular shape or a cylindrical shape. Most of the plurality of flanges 51 except one of them (there are three in the illustrated embodiment) are mounted on the end 9*a* of the cylindrical member 50, and the remaining flange member 51 (hereinafter, shown by 51*a*) is mounted on the other end 9*b* of the cylindrical member 50.

One flange member 51 (hereinafter, shown by 51*b*) of the plurality of flange members 51 mounted on the end 9*a* of the cylindrical member 50 is formed in an annular shape and fitted in an outer circumference of the cylindrical member 50. Another flange member 51 (hereinafter, shown by 51*c*) is formed in an annular shape and fitted in an outer circumference of the above-mentioned flange member 51*b*. Each of the other flange members 51 (hereinafter, shown by 51*d*) includes an annular ring portion 59 together with a cylindrical portion 60. The ring portion 59 is formed in a raised shape from an outer edge of the cylindrical portion 60. The flange member 51*d* has the ring portion fitted in an outer circumference of the flange member 51*c*.

A driven shaft 73 is rotatably supported on the above-mentioned flange member 51*d* by a roller bearing 74. The driven shaft 73 is formed in a cylindrical shape and disposed in a coaxial state with the cylindrical member 50 of the containing tank 9. The midair holding member 32 is compressed on an end surface of the driven shaft 73. The driven shaft 73 rotates with the midair holding member 32 and supports an end 32*a* as a free end of the midair holding member 32.

The above-mentioned flange member 51*a* is formed in an annular shape and fitted in an outer edge of the other end 9*b* of the cylindrical member 50. The flange member 51*a* allows the midair holding member 32 to pass inside thereof. In addition, the end 9*a* of the cylindrical member 50 forms an end of the containing tank 9 and the other end 9*b* of the cylindrical member 50 forms the other end of the containing tank 9.

Each of the pair of lopped waste sealing holders 52 is formed in an annular shape. One lopped waste sealing holder 52 is fitted in an inner circumference of the end 9*a* of the cylindrical member 50, and another lopped waste sealing holder 52 is fitted in an inner circumference of the other end 9*b* of the cylindrical member 50. The other lopped waste sealing holder 52 allows the midair holding member 32 to pass inside thereof.

Each of the pair of lopped waste sealing blades 53 is formed in a mesh form. One lopped waste sealing blade 53 is formed in a disc-like shape and disposed on an inner circumference of the end 9*a* of the cylindrical member 50 as well as being mounted on the one lopped waste sealing holder 52 mentioned above. In addition, the one lopped waste sealing blade 53 allows the driven shaft 73 to pass inside thereof. The other lopped waste sealing blade 53 is formed in an annular shape and disposed on the inner circumference of the other end 9*b* of the cylindrical member 50 as well as being mounted on the other lopped waste sealing holder 52 mentioned above. The other lopped waste sealing blade 53 allows the midair holding member 32 to pass inside thereof. The lopped waste sealing blade 53 allows the below-mentioned wire members 66 to hit the outer surface of the development sleeve 132 to control lopped waste, which is formed by being lopped from the development sleeve 132, to be released into an outside of the cylindrical member 50, that is to say, the containing tank 9.

Each of the pair of position members 54 is formed in a cylindrical shape. One position member 54 is fitted in an outer circumference of the end 32*a*, which is a free end of the midair holding member 32. Another position member 54 is fitted in an outer circumference of a central portion 32*b* of the midair holding member 32 which is positioned in the cylindrical member 50 and is close to the other end 9*b*. Each of the pair of position members 54 pinches the development sleeve 132 therebetween, and positions the development sleeve 132 on the midair holding member 32. In addition, the end 32*a* forms an end, which is close to the fixing holding portion 4 of the midair holding member 32 and is away from the moving holding portion 6. The central portion 32*b* forms an end, which is away from the fixing holding portion 4 of the midair holding member 82 and is close to the moving holding portion 6 in the containing tank 9.

The partition member 65 includes a body portion 61 formed in an annular shape, and a mesh portion 62. The body portion 61, that is to say, the partition member 55 is fitted in an inner circumference of the cylindrical member 50 to be mounted on the cylindrical member 50 as well as to allow the midair holding member 32 to pass inside thereof. The body portion 61, that is to say, the plurality of partition members 55 are disposed between the pair of lopped waste sealing blades 53. In addition, the body portion 61, that is to say, the plurality of partitions 55 are disposed parallel with intervals from each other along an axis P, that is to say, a longitudinal direction of the cylindrical member 50. In the illustrated embodiment, seven partition members 55 are provided.

A penetrating hole 63 is provided on the body portion 61. The mesh portion 62 is mounted on the body portion 61 so as to block or caulk the penetrating hole 63. The mesh portion 62 is formed in a mesh shape to allow gas and lopped waste to pass therethrough and to control the wire members 65 to pass.

The above-mentioned plurality of partition members 55 partition a space in the cylindrical member 50, that is to say, in the containing tank 9 along the axis of the cylindrical member 50, that is to say, of the containing tank 9, that is, the axis P of the development sleeve 132. In addition, the axis P forms both of the axis of the containing tank 9 and that of the midair holding member 32 as well as forming the longitudinal direction of the containing tank 9. That is, the axis P and the longitudinal direction of the containing tank 9 are parallel to each other. Moreover, both of the above-mentioned body portion 61 and the mesh portion 62, that is to say, the partition members 55 are formed of nonmagnetic materials.

Each of the pair of sealing blades 56 is formed in an annular shape. Moreover, the sealing blade 56 is formed in a mesh form and allows gas and waste to pass there through as well as to control the wire members 65 to pass. Another sealing blade 56 is mounted on the partition member 55, which is closest to the end 9*a*. The sealing blade 56 allows a below-mentioned cap 64 mounted on both ends of the development sleeve 132 to pass inside of the sealing blade 56. The sealing blade 56 controls the wire members 65 positioned between the partition members 56 to pass, and controls the flow-out of the wire members 65 to an outside of the cylindrical member 50, that is to say, the containing tank 9.

The containing tank 9 configured as mentioned above contains the wire members 65 comprised of a magnetic material between the plurality of partition members 55 as well as containing the development sleeve 132 mounted on the midair holding member 32 in the cylindrical member 50. That is, the containing tank 9 contains both of the development sleeve 132 and the wire members 65. In addition, the wire members 65 are allowed to hit the outer surface of the development sleeve 132, for example, by rotating or moving the outer circumference of the development sleeve 132 with the above-mentioned rotational magnetic field. The wire members 65 hit the outer surface of the development sleeve 132 so as to cut off a part of the development sleeve 132 therefrom, and thereby to roughen the outer surface of the development sleeve 132.

Figure 12:
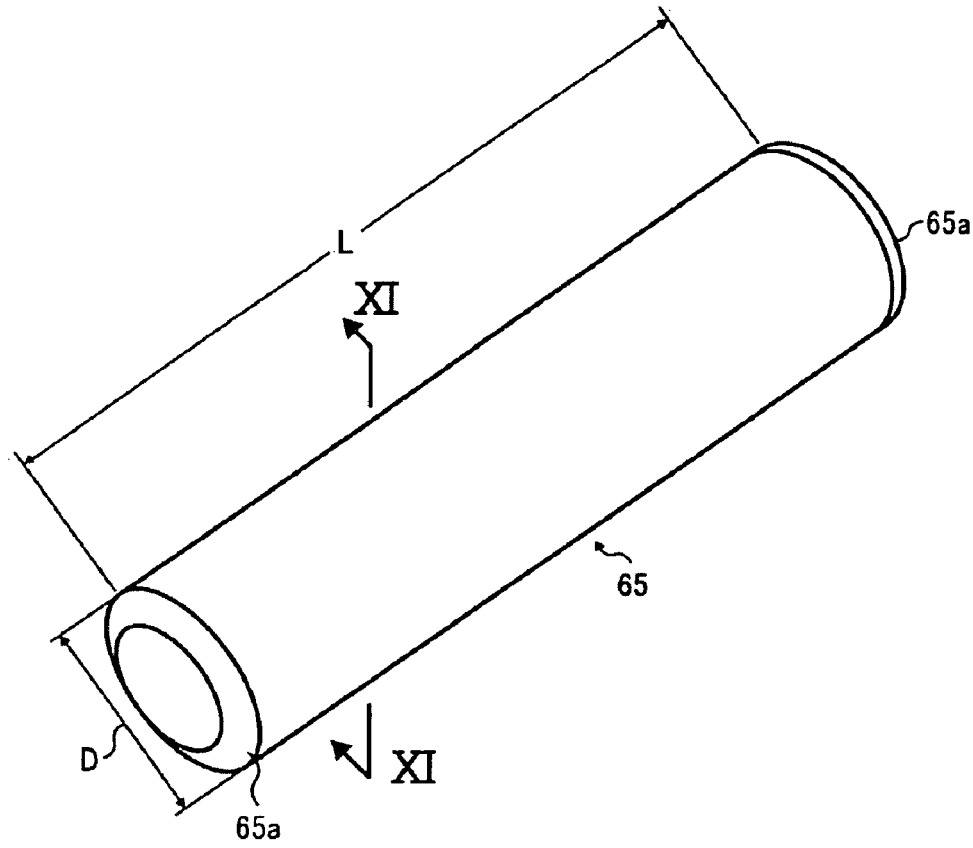
FIG. 12 is a schematic perspective view illustrating a wire member used in the surface processing device shown in FIG. 10.

The wire members 65 are formed by, for example, magnetic materials such as austenite stainless steel or martensite stainless steel. Each of the wire members 65 is formed in a short-line and cylindrical shape as shown in FIG. 12. The wire member 65 has an outer diameter ranging from 0.5 mm to 1.2 mm. The wire member 65 is formed in a shape where L/D is from 4 to 10 as L and D correspond to an entire length and an outer diameter, respectively.

Figure 13:
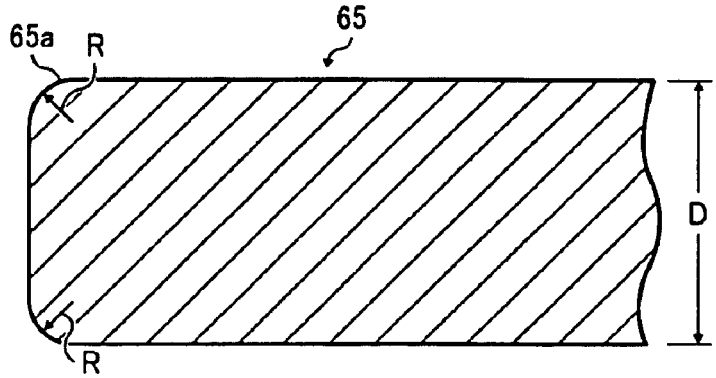
FIG. 13 is a schematic sectional view illustrating the wire member shown in FIG. 12 along line XI-XI.

Furthermore, each of outer edge portions 65*a* of both ends of the wire member 65 is chamfered in a circular arc shape in section throughout the entire circumference as shown in FIGS. 12 and 13. A curvature radius R of the outer edge portion 65*a* is from 0.05 mm to 0.2 mm.

Figure 14:
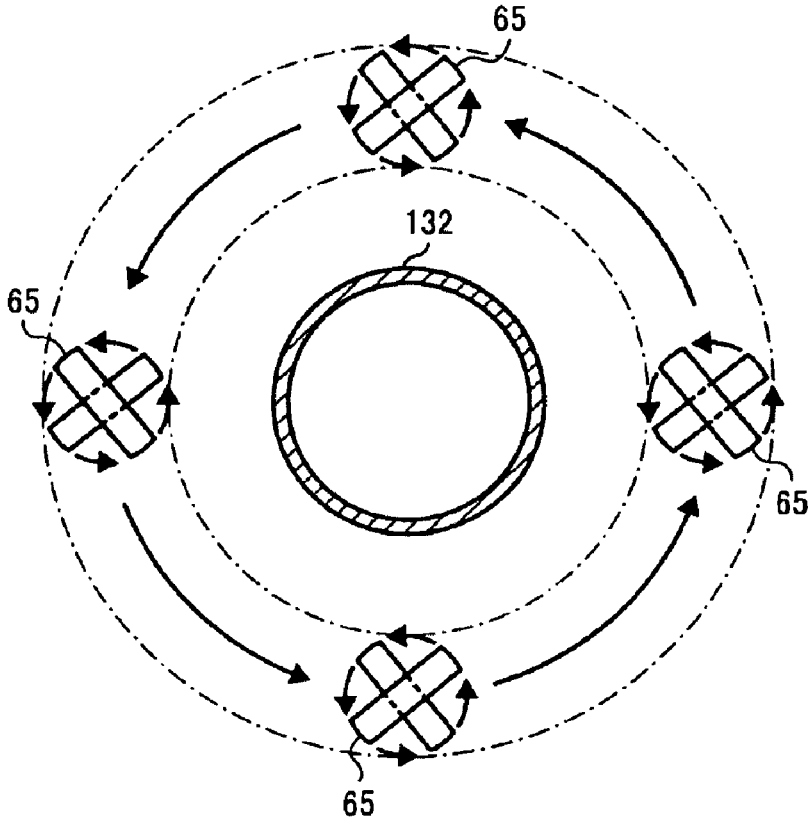
FIG. 14 is a schematic explanatory view illustrating the development sleeve shown in FIG. 10 and a wire member revolving the outer circumference of the development sleeve while rotating on an axis of the wire member.
Figure 15:
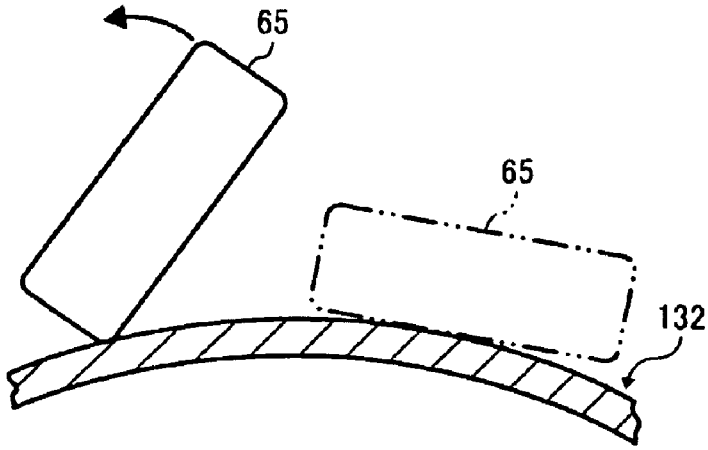
FIG. 15 is a schematic explanatory view illustrating a state where the wire member shown in FIG. 14 hits on the outer surface of the development sleeve.

The above-mentioned wire member 65 is rotated (orbited) in radial directions of the above-mentioned containing tank 9 and the development sleeve 132 while being rotated (rotated on its axis) about a center of the longitudinal direction of the above-mentioned rotational magnetic field thereby as shown in FIG. 14.

The collection portion 10 includes a gas entering tube 66, a gas exhausting hole 67, a mesh member 68, a gas exhausting duct 69, and a dust collection device 70 (see FIG. 10) as shown in FIG. 11. The gas entering tube 66 is provided to be close to an end of the cylindrical member 50, that is to say, of the containing tank 9 (the moving holding portion 6) from another lopped waste sealing holder 52 and opens into the cylindrical member 50, that is to say, the containing tank 9. Gas from a pressurized gas supplying source (not shown), and so on is supplied to the gas entering tube 66. The gas entering tube 66 guides the pressurized gas into the cylindrical member 50, that is to say, the containing tank 9.

The gas exhausting hole 67 penetrates the cylindrical member 50 to communicate with the inside and outside of the containing tank 9 and is provided to be nearer in relation to an end of the cylindrical member 50, that is to say, of the containing tank 9, which is away from the moving holding portion 6 from the other lopped waste sealing holder 52. The mesh member 68 is mounted on the cylindrical member 50 so as to block or caulk the gas exhausting hole 67. The mesh member 68 allows the lopped waste and gas to pass therethrough and controls the wire members 65 to pass. The mesh member 68 controls the flow-out of the wire members 65 into the outside of the cylindrical member 50, that is to say, the containing tank 9.

The gas exhausting duct 69 is a duct which is mounted on a vicinity of the gas exhausting hole 67. The gas exhausting duct 69 surrounds the outer edge of the gas exhausting hole 67. The gas exhausting hole 67 and the gas exhausting duct 69 guide the gas which is supplied from the gas entering tube 66 into the cylindrical member 50, that is to say, the containing tank 9 to an outside of the cylindrical member 50, that is to say, of the containing tank 9.

The dust collection device 70 is connected to the gas exhausting duct 69 and sucks the gas in the gas exhausting duct 69. The dust collection device 70 sucks the gas in the gas exhausting duct 69, so that the gas in the containing tank 9 is sucked together with the above-mentioned lopped waste. The dust collection device 70 collects the waste. The above-mentioned collection portion 10 supplies the gas into the cylindrical member 50, that is to say, the containing tank 9 through the gas entering tube 66 to guide the lopped waste to the outside of the cylindrical member 50, that is to say, the containing tank 9 through the gas exhausting hole 67 and the gas exhausting duct 69 by the gas and the dust collection device 70. Then, the collection portion 10 collects the lopped waste in the dust collection device 70.

The cooling portion 11 includes a cooling fan 71 and a cooling duct 72 as shown in FIG. 10. The cooling fan 71 supplies pressurized gas to the cooling duct 72. The cooling duct 72 is a duct and guides the pressurized gas supplied from the cooling fan 71 to the electro-magnetic coil 8. The cooling duct 72 whips the pressurized gas supplied from the cooling fan 71 onto the electro magnetic coil 8. The cooling portion 11 cools the electro-magnetic coil 8 by whipping the pressurized gas on the electro-magnetic coil 8.

The linear encoder 75 includes a body portion 77 and a probe 78 movably provided on the body portion 77 as shown in FIG. 11. The body portion 77 extends in a linear shape and is mounted on the base 3. The body portion 77 is disposed parallel to the rail 20 and between the pair of rails 20. An entire length of the body portion 77 is longer than that of the above-mentioned containing tank 9. The body portion 77 is disposed at a position where both ends thereof in a longitudinal direction of the body portion 77 are projected from the above-mentioned containing tank 9 toward an outside thereof along the longitudinal direction of the containing tank 9.

The probe 78 is movably provided along the longitudinal direction of the body portion 77, that is to say, of the containing tank 9. The probe 78 is mounted on the electro-magnetic coil holding base 18. That is, the probe 78 is mounted on the electro-magnetic coil 8 via the electro-magnetic coil holding base 18.

The above-mentioned linear encoder 75 detects a position of the probe 78 in relation to the body portion 77, that is to say, the containing tank 9, and outputs the detected result toward the control device 76. Thereby, the linear encoder 75 detects the relative position to the containing tank 9 of the electro-magnetic coil 8, that is to say, the development sleeve 132 and then outputs the detected result toward the control device 76.

The control device 76 may be a computer, which has a well-known RAM, ROM, CPU, and so on. The control device 76 is connected to the electro-magnetic coil moving portion 5, the moving holding portion 6, the moving chuck portion 7, the electro-magnetic coil 8, the inverter 49, the collection portion 10, the cooling portion 11, the linear encoder 75, and so on, and controls them to control all parts in the surface treatment device 1.

The control device 76 memorizes an intensity of the rotational magnetic field of the electro-magnetic coil 8 according to the relative position to the development sleeve 132 of the electro magnetic coil 8 detected by the linear encoder 75. That is, the control device 76 memorizes the electric power which is applied to the electro-magnetic coil 8 by the inverter 49 according to the relative position to the development sleeve 132 of the electro-magnetic coil 8. In addition, the control device 76 memorizes the above-mentioned electric power for each product number of the development sleeve 132.

In the illustrated embodiments, the control device 76 previously memorizes a pattern which gradually increases the electric power applied to the electro-magnetic coil 8 by the inverter 49 as the electro-magnetic coil 8 moves from the central portion toward both ends in the longitudinal direction of the development sleeve 132. Then, the control device 76 allows the inverter 49 to modify the intensity of the rotational magnetic field generated by the electro-magnetic coil 8 according to the pattern of the pre-memorized electric power mentioned above. Thereby, in the illustrated embodiments, the control device 76 allows the inverter 49 to modify the intensity of the magnetic field generated by the electro-magnetic coil 8 such that the rotational magnetic field during processing both ends of the development sleeve 132 becomes larger than the rotational magnetic field during processing of the central portion of the development sleeve 132. As mentioned above, the control device 76 allows the inverter 49 to modify the intensity of the rotational magnetic field generated by the electro-magnetic coil 8 according to the relative position to the containing tank 9, that is to say, the development sleeve 132 of the electro-magnetic coil 8 detected by the linear encoder 75.

Furthermore, some kinds of input devices such as a keyboard, some kinds of a display device such as 'display', and the like are connected to the control device 76.

Next, a process to manufacture the development sleeve 132 by treating (surface-roughened) the outer surface of the development sleeve 132 by use of the surface treatment device 1 having the above-mentioned structure is explained below.

At first, a part number or the like of the development sleeve 132 is input from the input device into the control device 76. An outer periphery of each of opposite ends of the development sleeve 132 is fitted in a cylindrical cap 64 in the longitudinal (axial) direction. Then an outer periphery of the midair holding member 32 is fitted in the other positioning member 54. The midair holding member 32 is passed in the development sleeve 132, which has the opposite ends where the caps 64 are attached. Thereafter, the outer periphery of the midair holding member 32 is fitted in the one positioning member 54. The chuck shaft 39 of the chuck cylinder 34 is retracted to fix the development sleeve 132 onto the midair holding member 32. At this time, the midair holding member 32 and the development sleeve 132 are in a coaxial state. Thus, the development sleeve 132 is mounted on the midair holding member 32.

The development sleeve 132 and the midair holding member 32 are contained in the containing tank 9 as well as the wire members 65 being supplied into the cylindrical member 50 of the containing tank 9. Consequently, the wire members 65 and the development sleeve 132 are contained in the containing tank 9. In addition, the containing tank 9 is chucked by the holding chucks 28 and 43. The development sleeve 132 and the containing tank 9 are attached to the moving holding portion 6. At this time, the cylindrical member 50 of the containing tank 9, the midair holding member 32 and the development sleeve 132 are in a coaxial state.

The above-mentioned operation is carried out while adjusting a position of the moving base 26 by the actuators 24 and 25. The above-mentioned operation is also carried out while adjusting a position of the holding base 41. One end portion 9*a* of the containing tank 9 is held to the fixing holding portion 4, for example, by allowing the one end portion 9*a* of the containing tank 9 to be chucked by the holding chuck 16.

While supplying gas into the containing tank 9 through the gas entering tube 66 of the collection portion 10 and sucking the gas in the containing tank 9 by the dust collection device 70, the pressurized gas is sprayed onto the electro-magnetic coil 8 by the cooling portion 11.

The development sleeve 132 is rotated about the axis P together with the midair holding member 32 by the driving motor 33. Thereafter, by applying power from a three-phase alternating electric source 48 to the electro-magnetic coil 8, a rotational magnetic field is generated in the electro-magnetic coil 8. At this time, each of the wire members 65 positioned inside the electro-magnetic coil 8 is rotated and orbited about the axis P (rotation and movement), so that the wire members 65 hit the outer surface of the development sleeve 132 to roughen the outer surface of the development sleeve 132.

When the moving portion 5 adequately moves the electro-magnetic coil 8 along the axis P, the wire members 65 entering the electro-magnetic coil 8 are moved (rotate and orbit about the axis) by the rotational magnetic field, while the wire members 65 discharged from the inner side of the electro-magnetic coil 8 are stopped. Because each of the partition members 55 partitions a space of the containing tank 9, the wire members 65 are prevented from moving over the partition member 55, so that the wire members 65 out of the inner side of the electro-magnetic coil 8 are out of the rotational electro-magnetic field. Furthermore, after the moving portion 5 reciprocates the predetermined rotational electro-magnetic coil 8 along arrow X, the surface-roughness of the development sleeve 132 is completed.

Furthermore, the electro-magnetic coil 8 generates a strong rotational magnetic field as it moves from the central portion to the opposite ends of the development sleeve 132. As the rotational magnetic field becomes stronger, the wire members 65 move more acutely. Consequently, as the rotational magnetic field strengthens, the wire members 65 hit the work more strongly to roughen the outer surface of the development sleeve 132.

When the roughing process of the outer surface of the development sleeve 132 is completed, the application of the power to the electro-magnetic coil 8 is stopped and the driving motor 33 is stopped. In addition, the collection portion 10 and the cooling portion 11 are also stopped. The holding of the containing tank 9 by the holding chuck 16 of the fixing holding portion 4 is released, and while the containing tank 9 is still held by the holding chuck 43 of the moving chuck portion 7 and the holding chuck 28 of the moving holding portion 6, the first actuator 24 separates the moving base 26 from the fixing holding portion 4 along arrow X. As a result, the containing tank 9 is separated from the fixing holding portion 4. The development sleeve 132 having the outer surface in which the roughening process is completed is taken out of the containing tank 9 and a new development sleeve 132 is contained in the containing tank 9. In this way, by roughening the outer surface of the development sleeve 132, the development sleeve 132 having the outer surface which is gradually roughened as it moves from the central portion to the opposite ends of the development sleeve 132 is obtained, as shown in FIG. 4.

Moreover, by the above-mentioned rotational magnetic field, each of the wire members 65 rotates about a central portion in a longitudinal direction thereof in such a manner that the longitudinal direction is oriented along, for example, radial directions of the containing tank 9 and the development sleeve 132, and orbits about the outer periphery of the development sleeve 132, as shown in FIG. 14. Therefore, as shown by a solid line in FIG. 15, an outer edge portion 65*a* of the wire member 65 hits the outer surface of the development sleeve 132. Consequently, a plurality of generally elliptical depressions 139 are randomly formed on the outer surface of the development sleeve 132, as shown in FIGS. 7 and 8. Of the generally elliptical depressions 139 formed on the outer surface of the development sleeve 132, there are more depressions along an axial direction of the development sleeve 132 than along a peripheral direction of the development sleeve 132.

According to the above process, the elliptical depressions 139 much larger than the concave portions formed by the conventional sand blast process are formed on the outer surface of the development sleeve 182. For example, a length of a major axis is about from 0.05 mm to 0.3 mm, and a length of a minor axis of each depression is about from 0.02 mm to 0.1 mm. Therefore, the depressions 139 undergo less wear even if a long period elapses, thereby preventing the reduction of the conveyed amount of the developer.

Because the development sleeve 132 has the outer surface provided with the randomly formed elliptical depressions 139, the developer is pooled in the depressions 139 in such a manner that places where the developer is pooled are randomly disposed on the outer surface. Accordingly, variations of the formed image are prevented from occurring.

As the long magnet body, the magnet block to generate the high magnetic force, which includes, for example, a rare-earth element, is disposed on a part corresponding to the development area 131 of the roller body 140 of the magnet block 141. Thereby, a good ability to convey the developer in the development area is achieved so that variation of an image can be prevented from occurring.

Since the magnet block 141 which is obtained by compression-molding of the compression molding compounds 150A, 150B in the magnetic field is used, the density of the binder resin can be reduced to form the magnet block 141 having high magnetic property. Thereby, the magnet block 141 having high magnetic force of 13 MGOe or more (100 mT or more) can be obtained. Accordingly, good ability to convey the developer in the development area can be achieved so that variation of images can be prevented.

The bulk density of the magnetic powder 151 is adjusted between 3.3 g/cm$^3$ and 4.0 g/cm$^3$, and the magnetic particles 152 of the magnetic powder 151 are closely filled when molding. Accordingly, the density of the magnetic powder 151 can be increased to provide the magnet block 141 having high magnetic force.

The mean diameter of the thermoplastic resin particles 153 is adjusted in 1/10 of that of the magnetic particles 152 of the magnetic powder 151, so that the spaces between the magnetic particles 152 of the magnetic powder 151 can be filled with the thermoplastic resin particles 153. Thereby, the magnet block 141 can have high molding density. Accordingly, magnetic property of the magnet block 141*a* can be improved.

If the thermoplastic resin particles 153 are produced in a spherical state by the emulsion polymerization or the suspension polymerization, high density of the compression molding product is achieved and thus the magnetic property can be improved. Due to the spherical state of the thermoplastic resin particles, the covering area of the thermoplastic resin particles 153 to the magnetic particles 152 is increased so that the exposed area of the magnetic particles 152 of the magnetic powder 151 on the surface of the magnet block 141 can be reduced to provide a rusting-prevention effect.

There are more depressions 139 of which the major axis of each is oriented along the axial direction of the development sleeve 132 than the depressions of which the major axis of each of the depressions is oriented along the peripheral direction of the development sleeve 132, so that places of the picked developer 126 are arranged in parallel along the axial direction of the development sleeve 132. Therefore, even if the development sleeve 132 rotates, it is difficult for the picked up developer 126 to be removed from the outer surface of the developer sleeve 132. Accordingly, the elliptical depressions 139 have advantageous effects in that the picked up amount of the developer can be reliably ensured in addition to the same advantageous effect as in the conventional V-shaped grooves.

In addition, because the wire members 65 randomly hit the outer surface of the development sleeve 132 to form the elliptical depressions 139, the axis of the development sleeve 132 can be prevented from being curved, the inner and outer diameters of the development sleeve 132 can be prevented from being changed, and a sectional shape of the development sleeve 132 can be prevented from being deformed into an elliptical shape. That is to say, it is possible to maintain the wobble accuracy of the development to a degree of high accuracy.

Moreover, the randomly disposed concave and convex portions are formed in the development sleeve 132 so that the generation of variations in an amount of the developer supplied to the photoconductive drum 108 can be eliminated, thereby the variation in the density of the formed image can be prevented.

Because the wire members 65 disposed in the rotational magnetic field hit the outer surface of the development sleeve 132, the wire members 65 can more randomly hit the outer surface of the development sleeve 132. Consequently, more uniform concave and convex portions can be formed on the outer surface of the development sleeve 132 so that a more uniform image can be obtained.

By positioning the wire members 65 in the rotational magnetic field, because the concave and convex portions can be formed on the outer surface of the development sleeve 132, the number of processes in forming the concave and convex portions on the outer surface of the development sleeve 132 can be prevented from increasing, and thus complicated processes to form the concave and convex portions and a high cost for processing the outer surface of the development sleeve 132 can be avoided.

In addition, by positioning the wire members 65 in the rotational magnetic field, because the concave and convex portions can be formed on the outer surface of the development sleeve 132, it is possible to rotate each of the wire members about the central portion of each wire member in the longitudinal direction and orbit about the periphery of the development sleeve 132 in such a manner that the longitudinal direction of the wire member is oriented along the radial direction of the rotational magnetic field.

Therefore, the outer edge portions of the opposite ends of each wire member 65 in the longitudinal direction hit the development sleeve 132 to form the depressions 139. In this case, there are more depressions 139 disposed along the axial (longitudinal) direction of the development sleeve 132 than disposed along the peripheral direction of the development sleeve 132. Therefore, the elliptical depressions 139 formed on the outer surface of the development sleeve 132 have advantageous effects in that the picked up amount of the developer can be reliably ensured in addition to the same advantageous effect as in the conventional V-shaped grooves.

Because the wire members 65 can randomly hit the outer surface of the development sleeve 132 by the rotational magnetic field, the depressions 139 formed on the outer surface are more reliaby randomly disposed. Accordingly, variations in an image formed by the development sleeve 132 can be prevented from occurring.

Because the development sleeve 132 is contained in the containing tank 9 together with the wire members 65, the wire members can reliably hit the outer surface of the development sleeve 132. Consequently, it is possible to reliably provide the roughening treatment on the outer surface of the development sleeve 132.

Because the wire members 65 hit the rotating development sleeve 132 in the containing tank 9, the wire members 65 more randomly hit the outer surface of the development sleeve 132. Accordingly, the depressions 139 can be uniformly formed at the same time as higher accuracy is maintained so that an image having less variation can be obtained.

According to the above-mentioned image forming apparatus 101, because the developer in which the magnetic carrier 135 includes particles each having an average diameter of 20 μm or more and 35 μm or less is used, a good granular degree can be accomplished, and an improved image having less variation can be obtained. If the average diameter of the magnetic carrier particles 135 is less than 20 μm, because each of the magnetic carrier particles 135 has a lesser magnetic force from the development roller 115, this may cause an undesirable problem in that the magnetic carrier 135 could easily be separated from the development roller 115 and be attached to the photoconductive drum 108. If the average diameter of the magnetic carrier particles 135 is more than 35 μm, because an electric field between the magnetic carrier 135 and the electrostatic latent image on the photoconductive drum 108 is poor in roughness, this may cause an undesirable problem in that a uniform image cannot be obtained and deterioration of the image occurs.

The image forming apparatus 101 and the process cartridges 106Y, 106M, 106C and 106K have the above-mentioned development device 113, so that a high quality image can be obtained throughout a long period.

Furthermore, when the interval between the development sleeve 132 and the photoconductive drum 108 is from 0.1 mm to 0.4 mm, the toner can be reliably supplied to the photoconductive drum 108 from the developer raised on the development sleeve 132 so that the high-quality image can be obtained. It is not preferable that the interval between the development sleeve 132 and the photoconductive drum 108 be less than 0.1 mm, because the electric field between the development sleeve 132 and the photoconductive drum 108 is too large so that the magnetic carrier 135 is transferred to the photoconductive drum 108. It is not preferable that the interval between the development sleeve 132 and the photoconductive drum 108 be more than 0.4 mm, because the electric field between the development sleeve 132 and the photoconductive drum 108 is too small so that an amount of the toner supplied to the photoconductive drum 108 is reduced. In this case, because an edge effect of the electric field becomes large in an edge of the image as well as the development effect decreasing, a uniform image cannot be obtained.

The developer has the magnetic carrier particles 135, in each of which the core member 136 is covered with the plastic coating membrane 137. The plastic coating membrane is formed from a plastic component obtained by cross-linking a thermoplastic resin and melamine resin. The plastic component includes a charged adjuster. When using the above-mentioned developer, because in the magnetic carrier 135, the core member 136 is coated with the plastic coating membrane having elasticity, the plastic coating membrane 137 absorbs shocks due to their elasticity so that the magnetic carrier 135 is prevented from being abraded or chipped. Therefore, a longer lasting magnetic carrier 135 can be realized than in the conventional magnetic carrier.

Furthermore, the aluminum particles 138, each of which has a larger thickness than that of the plastic coating membrane 137 may be dispersed in the above-mentioned plastic coating membrane 137. As mentioned above, the developer having the magnetic carrier 135 where the aluminum particles 138 are provided to be projected from an outer surface of the plastic coating membrane 137 is used. Therefore, the aluminum particles 138 are prevented from hitting the plastic coating membrane 137 and a spent developer can be cleaned.

Because a spent developer and abrasion of the plastic coating membrane 137 can be prevented, a longer lasting magnetic carrier 135 can be realized than in the conventional magnetic carrier. Therefore, the stability of the amount of the picked-up toner can be achieved and the high-quality of the images can be obtained over the long term.

As the toner prepared by the emulsion polymerization method or the suspension polymerization method is selected, there are advantageous effects in that a good sphericity of the toner particles is achieved and the irregularity of the concentration, which remains on the image is visually improved.

When the outer diameter D of each of the wire members 65 is 0.5 mm or more and 1.2 mm or less, the concave and convex portions formed on the outer surface of the development sleeve 132 as a work piece do not easily wear even if a long period elapses so that the reduction of the picked up amount of the developer 226 by the development sleeve 132 can be prevented. Accordingly, reduction of a thinness of the image can be prevented throughout a long period.

Consequently, at this time, it is possible to provide the wire members 65 and the surface treatment device 1 which perform the roughening treatment on the outer surface of the development sleeve 132 and in which the lowering of the conveyed amount of the developer can be reduced and the generation of the variations in the image can be prevented.

When the ratio (L/D) of the entire length L and the outer diameter D of the wire member 65 is 4 or more and 12 or less, the outer edge portions 65*a* of each of the opposite ends of the wire member 65 in the longitudinal direction reliably hit the development sleeve 132. In this case, the entire length of the wire member 65 is sufficient to form the concave and convex portions each having sufficient size and depth on the outer surface of the development sleeve 132. Therefore, it is possible to reliably form the concave and convex portions on the outer surface of the development sleeve 132, and ensure a sufficient picked up amount of the developer in the development sleeve 132.

Furthermore, when the circular-arc chamfering section is provided on the outer edge portion 65*a* of each of the opposite ends of the wire member 65 in the longitudinal direction, smooth concave and convex portions can be formed on the outer surface of the development sleeve 132 so that the secular variation of the developer of the development sleeve 132, in particular, the magnetic carrier 135 or the like can be prevented.

When the curvature radius R of the sectional shape of the outer edge portion 65*a* formed on each of the opposite ends of the wire member 65 is 0.05 mm or more and 0.2 mm or less, it is possible to form the smooth concave and convex portions on the outer surface of the development sleeve 132.

When the wire member 65 is made of stainless steel of an austenite system or martensite system, it is possible to accomplish easy access to the wire member 65 so that a cost for the wire member 65 can be reduced.

The control device 76 can change the intensity of the rotational magnetic field generated by the electro magnetic coil 8 based on a relative position of the electro magnetic coil 8 to the development sleeve 132, that is, the containing tank 9. At this time, if the rotational magnetic field is intensive, a movement of the wire members 65 becomes active. Accordingly, because a high kinetic energy for the wire members to hit the outer surface of the development sleeve 132 is formed, the development sleeve 132 has a more roughened outer surface.

Thereby, the roughness of any position of the outer surface of the development sleeve 132 in the longitudinal or axial direction can be arbitrarily changed. Accordingly, a picked up amount of the developer at any position of the development sleeve 132 can be increased or decreased. In addition, it is possible to roughen the surface of the development sleeve 132 at a position where a picked up amount of developer is less to increase the picked up amount of the developer on the surface and prevent the variation of the image formed by the image forming apparatus 101 having the development sleeve 132. In this way, it is possible to perform the roughening treatment on the outer surface of the development sleeve 132 so as to prevent the image variation from occurring.

When the control device 76 changes the intensity of the rotational magnetic field depending on a predetermined pattern, it is possible to perform the roughening treatment on the outer surface of the development sleeve 132 with the constant pattern at any time.

When the control device 76 controls the electro-magnetic coil 8 to strengthen the rotational magnetic field in processing the opposite ends of the development sleeve 132 more than that in processing the central portion of the development sleeve 132, the surfaces on the opposite ends having a less picked up amount of developer are formed to be rougher than those on the central portion having a greater picked up amount of developer to increase the picked up amount of developer on the opposite ends. Consequently, it is possible to reliably prevent the variation in the image formed by the image forming apparatus 101 including the development sleeve 132 from occurring. In this way, it is possible to perform the roughening treatment on the outer surface of the development sleeve 132 to prevent the generation of the image variation.

The movement of the electro-magnetic coil 8 causes the processing of the development sleeve 132 to execute and the wire members 65 to acutely move out of the rotational magnetic field. Therefore, the intensity of the magnetic field acting on the wire members 65 is rapidly reduced so that a magnetic domain aligned in the wire members 65 is misaligned to decrease magnetization intensity, whereby there is an advantageous effect in that residual magnetization of the wire members 65 is removed simultaneously with the processing of the development sleeve 132.

As a result, it is not necessary to have a degaussing device to demagnetize the residual magnetization of the wire members 65 which is provided separately from the surface treatment device 1. Accordingly, the demagnetization of the wire members 65 can be easily accomplished so that it is possible to execute continuous processing of the development sleeve 132 throughout a long time to improve processing efficiency of the surface treatment. Therefore, the surface treatment device 1 suitable for being used for a mass-produced device to mass-produce the development sleeve 132 can be obtained.

Because the development sleeve 132 is disposed and held in the central portion of the containing tank 9, the wire members 65 can uniformly hit the outer surface of the development 132 to uniformly process the outer surface of the development sleeve 132.

The movement or orbital motion of the wire members 65 about the outer periphery of the development sleeve 132 allows the wire members 65 to reliably hit the outer surface of the development sleeve 132 so that the processing of the development sleeve 132 can be reliably accomplished.

Because the development sleeve 132 is rotated, the wire members 65 can uniformly hit the outer surface of the development sleeve 132 to process further uniformly the outer surface of the development sleeve 132.

When the electro magnetic coil 8 has a shorter length than that of the containing tank 9, it is possible for the surface treatment device 1 to generate a stronger rotational magnetic field than that of an electro magnetic coil having generally the same length as the containing tank 9 and thus to reduce loss of the rotational magnetic field generated in the containing tank 9. Accordingly, high processing efficiency of the development sleeve 132 can be accomplished and power consumption can be reduced.

Also, when the electro magnetic coil 8 has a shorter length than that of the containing tank 9, it is possible to support the opposite ends of the containing tank 9. Thereby, the containing tank 9 can be prevented from moving with the movement of the wire members 65 or the like, so that the wire members 65 can further uniformly hit the outer surface of the development sleeve 132, and the outer surface of the development sleeve 132 can be further uniformly processed.

If the containing tank 9 has a cylindrical shape, a motion of each wire member 65 in a peripheral direction when the rotational magnetic field is applied to the wire members 65 can not be blocked by the containing tank 9. As a result, stable processing of the development sleeve 132 can be accomplished.

The space of the containing tank 9 is partitioned by the partition member 55 in the longitudinal direction. This causes a movable area (rotation of itself and orbital motion) of each of the wire members 65 to be limited by the partition member 55 so that processing efficiency of the development sleeve 132 can be improved.

In addition, when the movement of the wire member 65 passing over the partition member 55 can be prevented, the wire member 65 and the rotational magnetic field can be reliably moved relatively, and each of the wire members 65 can be reliably demagnetized.

Because the partition member 65 is made of a non-magnetic material in the above-illustrated examples, the partition member 55 is not magnetized, so that the motion of the wire member 65 is not blocked by the partition member 55. In addition, cut dust or the like is prevented from being magnetized and adhered to the partition member 55. Consequently, the stable processing of the development sleeve 132 can be accomplished.

Because the plurality of partition members 55 are provided in the above-mentioned embodiments, it is possible to divide a range of the outer surface of the development sleeve 132 to be roughened. Therefore, the above-mentioned movable area of each of the wire members 65 can reliably be limited by the partition members 55, and thus the processing of the development sleeve 132 can be efficiently accomplished.

Here, because the movement of the wire members 65 passing over the partition members 55 can be limited, each of the wire members 65 can be reliably demagnetized.

Because an outer wall of the containing tank 9 made of a cylindrical member 50 has a single wall structure, it is possible to set the configuration so as to have a short distance between the electro-magnetic coil 8 and the development sleeve 132 and thus the rotational magnetic field generated by the electro-magnetic coil 8 can be efficiently employed for the processing of the development sleeve 132.

The sealing blades 56 prevent each of the wire members 65 from flowing out of the containing tank 9 to accomplish improved workability and productivity when processing. Such effects are further enhanced by continuously processing the development sleeve 132. The surface treatment device 1 is capable of performing the surface treatment of the development sleeve 132, which is efficiently and safely mass-produced.

In the above-mentioned image forming apparatus 101, each of the process cartridges 106Y, 106M, 106C, and 106K includes the cartridge case 111, the charged roller 109, the photoconductive drum 108, the cleaning blade 112 and the development device 113. However, each of the process cartridges 106Y, 106M, 106C, and 106K may include at least the development device 113, but not include the cartridge case 111, the charged roller 109, the photoconductive drum 108, and the cleaning blade 112. Moreover, in the above-mentioned embodiments, the image forming apparatus 101 is configured to include the process cartridges 106Y, 106M, 106C and 106K removably attached to the main body 102. However, the image forming apparatus 101 may include at least the development device 113, but not include the process cartridges 106Y, 106M, 106C and 106K.

In the above-mentioned embodiments, the outer diameter of the development sleeve 132, the size of each of the wire members 65, and the outer diameter of the cylindrical member 50 of the containing tank 9 may be optionally changed. It is desirable to adequately select the shape of the opposite ends of the development sleeve 132 under considerations of the curvature radius, the size and the shape of the chamfering, the desired roughness of the outer surface, the working time and conditions, the number of reciprocating movements of the electro-magnetic coil 8, durability of the wire members 65 or the like. It is preferable that the total amount of the wire members 65 contained in the containing tank 9 be adequately set under considerations of the desired roughness of the outer surface, the working time and conditions, the number of reciprocating movements of the electro-magnetic coil 8, durability of the wire members 65 or the like.

According to the magnet roller of the prevent invention, low cost performance for equipment can be achieved while application defects due to attachment of foreign objects can be prevented. Since the magnet roller enables the stable application, it can be broadly used for forming a coating film on an outer surface of a cylindrical object or a fixing belt.

According to the magnet roller of the above-mentioned embodiments of the present invention, advantageous effects can be provided as follows.

Even when attaching the magnet roller, in maintenance of the magnet roller, or under thermal history in use, a part of the magnet block is effectively prevented from being damaged, or the image failure is prevented from occurring. In addition, the long magnetic metal member contributes to improvement of rigidity of the entire magnet roller. Moreover, if the material having high magnetic force density, such as a molded compound including, for example, a rare-earth magnetic composition is selected as the long magnet body, using the material as the development main pole allows the main pole to have the high magnetic force. Furthermore, since the magnetic metal member is disposed adjacent to the long magnet body, a magnetic wave shape in the development area is prevented from being affected.

Due to the convex portion being provided on the magnetic metal member and the concave portion being provided on the roller body, the magnetic metal member and the roller body are reliably integrated so that the durability and the rigidity of the entire magnet roller can be improved. In addition, the adhesive can be dispensed with.

In a case where the magnetic metal member is used as an insert in molding, the magnetic metal member is easily deformed due to a difference in a thermal contraction between the roller body (made of a plastic magnet) and the magnetic metal member because the roller body is more largely contracted to a greater degree and the magnetic metal member is entirely and reliably fixed on the roller body. However, according to the above structures of the present invention, the deformation can be prevented and sufficient form accuracy can be ensured.

If the convex portion has one projection, it is advantageous in that the rigidity of the entire magnet roller and the form accuracy can be effectively improved by simple configurations. As a result, a small and rigid magnet roller having a high magnetic force can be obtained so that reduction of size of the development device, the process cartridge, or the image forming apparatus using the magnet roller can be achieved.

If the convex portion has two projections disposed with an interval in the width direction of the magnetic metal member (thereby, the magnetic metal member has a U-shape in section perpendicular to the longitudinal direction of the magnetic metal member), the roller body and the magnetic metal member are strongly fixed. A sectional area of the magnetic metal member becomes large as well as the magnetic metal member being formed in the U-shaped form in section, so that higher rigidity can be ensured.

If the width of the magnetic metal member is larger than that of the magnet body, the rigidity of the entire magnet roller can be more effectively improved.

If the magnet body is formed by the magnet compound made of the magnet powder including a rare-earth element and thermoplastic resin particles, magnetic force on the magnet body can be further improved (for example, up to 120 mT), so that the magnet roller having high magnetic flux density required for the main pole can be obtained at comparably low cost.

Since the roller body has magnetic anisotropy in one direction, high magnetic flux density of the magnetic roller can be achieved.

If the magnetic metal member is used as an insert in the injection-molding, the roller body and the magnetic metal member are effectively and easily integrated so that the rigidity of the entire magnet roller can be further effectively improved.

Since the durability of the magnet roller is improved, cracks or the like on the magnet body in use or in maintenance can be prevented from occurring.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. A magnet roller, comprising a cylindrical roller body including a side surface in which a groove having a flat bottom surface is formed;

a magnet body which is disposed in the groove; and a magnetic metal member which is attached to a surface of the magnet body, which is remote from an opening of the groove, wherein a width of the magnetic metal member in a direction perpendicular to an axis of the cylindrical roller body and parallel to the bottom surface of the groove is larger than a width of the magnet body, wherein the magnetic metal member has a convex portion extending at a center of the magnetic metal member in a longitudinal direction of the magnetic metal member, and wherein the roller body has a concave portion in which the convex portion of the magnetic metal member is fitted.

2. The magnet roller according to claim 1, wherein the magnetic metal member is disposed adjacent to an axis side surface of the magnet body, which is close to the axis of the roller body.

3. The magnet roller according to claim 1, wherein the groove has a rectangular shape in section perpendicular to the axis of the roller body.

4. The magnet roller according to claim 1, wherein the magnetic metal member is adjacent to the bottom surface of the groove.

5. The magnet roller according to claim 1, wherein the magnetic metal member has an axis which is parallel to the axis of the roller body.

6. The magnet roller according to claim 1, wherein the magnetic metal member has a rectangular shape in section.

7. The magnet roller according to claim 1, wherein the convex portion of the magnetic metal member extends in a direction away from the opening of the groove.

8. The magnet roller according to claim 1, wherein the convex portion of the magnetic metal member extends toward the axis of the roller body.

9. The magnet roller according to claim 1, wherein the convex portion has a projection.

10. The magnet roller according to claim 1, wherein the convex portion has two projections which are disposed with an interval from each other in a width direction of the magnetic metal member.

11. The magnet roller according to claim 1, wherein the magnet body is made of a magnet compound having magnet powder including a rare earth element and thermoplastic resin particles.

12. The magnet roller according to claim 1, wherein the roller body has magnetic anisotropy in one direction.

13. A method for producing the magnet roller according to claim 1, comprising the step of:

forming the roller body by an injection-molding by use of the magnetic metal member as an insert.

14. A magnetic particle supporting body, comprising the magnet roller according to claim 1.

15. A development device, comprising the magnetic particle supporting body according to claim 14.

16. A process cartridge comprising the development device according to claim 15.

17. An image forming apparatus comprising the process cartridge according to claim 16.

* * * * *